US012305487B2

(12) United States Patent
El Mallawany et al.

(10) Patent No.: US 12,305,487 B2
(45) Date of Patent: May 20, 2025

(54) MULTILATERAL JUNCTION INCLUDING A NON-THREADED-COUPLING

(71) Applicant: Halliburton Energy Services, Inc., Houston, TX (US)

(72) Inventors: Ibrahim El Mallawany, Al-Khobar (SA); Jamie Revelle Weber, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/939,380

(22) Filed: Sep. 7, 2022

(65) Prior Publication Data

US 2024/0076960 A1 Mar. 7, 2024

(51) Int. Cl.

| | |
|---|---|
| ***F16L 37/08*** | (2006.01) |
| ***E21B 7/06*** | (2006.01) |
| ***E21B 17/18*** | (2006.01) |
| ***E21B 41/00*** | (2006.01) |
| ***E21B 43/26*** | (2006.01) |

(52) U.S. Cl.

CPC ..... *E21B 41/0042* (2013.01); *E21B 7/06* (2013.01); *E21B 17/18* (2013.01); *E21B 43/26* (2013.01)

(58) Field of Classification Search

CPC ..... E21B 41/0042; E21B 43/106; F16L 37/0842; F16L 37/091; F16L 37/142; F16L 37/088

See application file for complete search history.

(56) References Cited

U.S. PATENT DOCUMENTS

| | | | | |
|---|---|---|---|---|
| 2,242,378 | A | 5/1941 | Vollbach et al. | |
| 2,397,070 | A * | 3/1946 | Zublin | E21B 7/061 166/50 |
| 4,489,782 | A | 12/1984 | Perkins | |
| 4,830,408 | A | 5/1989 | Reimert | |
| 4,898,243 | A | 2/1990 | Lindsey et al. | |
| 5,050,911 | A * | 9/1991 | Morrison | F16L 55/10 285/321 |

(Continued)

FOREIGN PATENT DOCUMENTS

| | | | |
|---|---|---|---|
| CN | 209724292 | U | 12/2019 |
| CN | 213116260 | U | 5/2021 |

(Continued)

*Primary Examiner* — Kenneth L Thompson

(74) *Attorney, Agent, or Firm* — Scott Richardson; Parker Justiss, P.C.

(57) ABSTRACT

Provided is a multilateral junction and a well system. The multilateral junction, in one aspect, includes a housing, the housing including a first housing end and a second housing end, a bore extending through the housing from the first housing end to the second housing end, and a bore coupling profile located along an inside surface of the bore proximate the second housing end. The multilateral junction, according to this aspect, further includes a multilateral bore leg extending into the bore, the multilateral bore leg including a tubular having a first tubular end and a second tubular end, and a tubular coupling profile located along an outside surface of the tubular proximate the first tubular end. The multilateral junction, according to this aspect, further includes an arced coupling located between the bore and the tubular and engaged with the bore coupling profile and the tubular coupling profile.

28 Claims, 30 Drawing Sheets

(56) References Cited

U.S. PATENT DOCUMENTS

| | | | | |
|---|---|---|---|---|
| 5,383,694 | A * | 1/1995 | Taeuber, Jr. | F16L 37/148 285/305 |
| 5,845,945 | A * | 12/1998 | Carstensen | F16L 1/18 285/334.3 |
| 5,960,873 | A * | 10/1999 | Alexander | E21B 7/061 166/117.6 |
| 6,079,493 | A * | 6/2000 | Longbottom | E21B 43/14 166/117.6 |
| 6,209,648 | B1 * | 4/2001 | Ohmer | E21B 41/0042 166/380 |
| 6,561,277 | B2 | 5/2003 | Algeroy et al. | |
| 7,497,264 | B2 | 3/2009 | Moody et al. | |
| 8,701,775 | B2 | 4/2014 | Steele | |
| 9,777,554 | B2 * | 10/2017 | Tunget | E21B 43/14 |
| 10,359,132 | B2 * | 7/2019 | Hartmann | F16L 15/08 |
| 10,472,933 | B2 * | 11/2019 | Steele | E21B 34/06 |
| 11,566,502 | B2 * | 1/2023 | Enerstvedt | E21B 41/0042 |
| 11,649,683 | B2 * | 5/2023 | Wolf | E21B 19/16 166/242.6 |
| 2004/0159444 | A1 | 8/2004 | Wolters et al. | |
| 2012/0305268 | A1 | 12/2012 | Steele | |
| 2015/0240571 | A1 * | 8/2015 | Bowles | E21B 17/04 285/351 |
| 2017/0107794 | A1 | 4/2017 | Steele | |
| 2017/0241241 | A1 * | 8/2017 | Pendleton | E21B 47/10 |
| 2018/0274300 | A1 | 9/2018 | Vemuri et al. | |
| 2021/0062618 | A1 | 3/2021 | Steele et al. | |

FOREIGN PATENT DOCUMENTS

| | | | |
|---|---|---|---|
| KR | 101442538 | B1 | 9/2014 |
| KR | 101536472 | B1 | 7/2015 |
| WO | 2015012854 | A1 | 1/2015 |
| WO | 2017079627 | A1 | 5/2017 |

* cited by examiner

300

400

500

MULTILATERAL JUNCTION INCLUDING A NON-THREADED-COUPLING

BACKGROUND

A variety of borehole operations require selective access to specific areas of the wellbore. One such selective borehole operation is horizontal multistage hydraulic stimulation, as well as multistage hydraulic fracturing ("frac" or "fracking"). In multilateral wells, the multistage stimulation treatments are performed inside multiple lateral wellbores. Efficient access to all lateral wellbores is critical to complete a successful pressure stimulation treatment, as well as is critical to selectively enter the multiple lateral wellbores with other downhole devices.

BRIEF DESCRIPTION

Reference is now made to the following descriptions taken in conjunction with the accompanying drawings, in which:

FIGS. 3F and 3G illustrate an alternative embodiment employing an arced coupling, bore coupling profile and tubular coupling profile to axially fix the lateral completion engagement sub to the first and/or second lateral bore legs;

DETAILED DESCRIPTION

Figure 1:
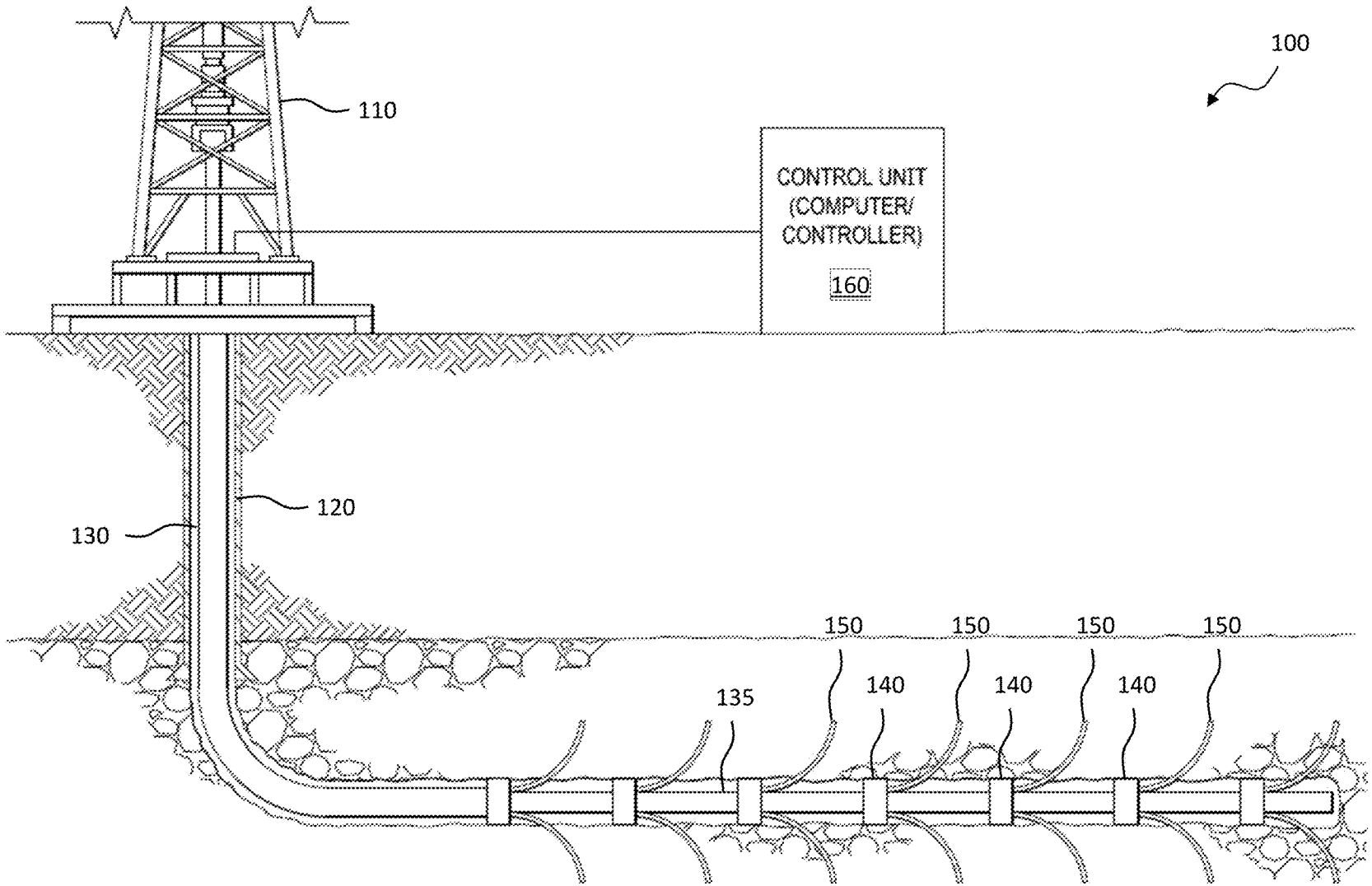
FIG. 1 illustrates a well system for hydrocarbon reservoir production, the well system including a multilateral junction designed, manufactured and operated according to one or more embodiments of the disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to a direct interaction between the elements and may also include an indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water such as ocean or fresh water.

Referring now to FIG. 1, illustrated is a diagram of a well system 100 for hydrocarbon reservoir production, according to certain example embodiments. The well system 100 in one or more embodiments includes a pumping station 110, a main wellbore 120, tubing 130, 135 (e.g., which may have differing tubular diameters), a plurality of multilateral junctions 140, and lateral legs 150 with additional tubing integrated with a main bore of the tubing 130, 135. Each multilateral junction 140 may comprise a junction designed, manufactured or operated according to the disclosure, including a multilateral junction including an arced coupling or toothed coupling as described below. The well system 100 may additionally include a control unit 160. The control unit 160, in one embodiment, is operable to provide a control signal to the multilateral junctions and/or lateral legs 150, as well as other devices downhole.

Figure 2:
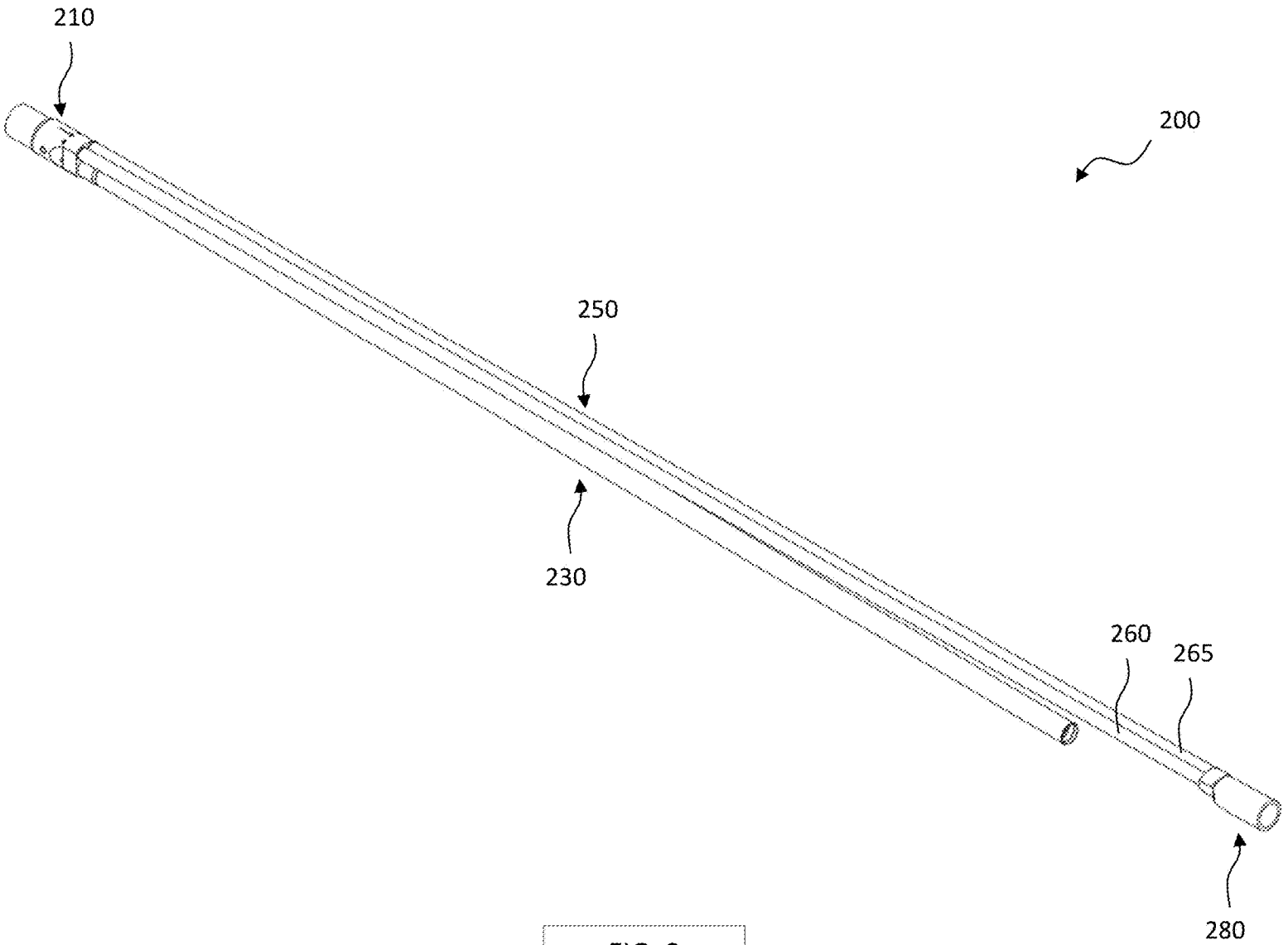
FIG. 2 illustrates an isometric view of a multilateral junction designed, manufactured and operated according to one or more embodiments of the disclosure.

Turning to FIG. 2, illustrated is an isometric view of a multilateral junction 200 designed, manufactured and operated according to one or more embodiments of the disclosure. The multilateral junction 200, in the illustrated embodiment, includes a y-block 210. Coupled to the y-block 210, in the illustrated embodiment, are a main bore leg 230, as well as a lateral bore leg 250. In the illustrated embodiment of FIG. 2, the lateral bore leg 250 includes a first lateral bore leg 260 and a second lateral bore leg 265, as might be used to increase flow volume. Further to the embodiment of FIG. 2, the multilateral junction 200 includes a lateral completion engagement sub 280. The lateral completion engagement sub 280, in the illustrated embodiment, recombines the first lateral bore leg 260 and second lateral bore leg 265 back into a single fluid path, as well as may be used to engage with (e.g., "stab" into) a lateral completion located in the lateral wellbore.

Figure 3A:
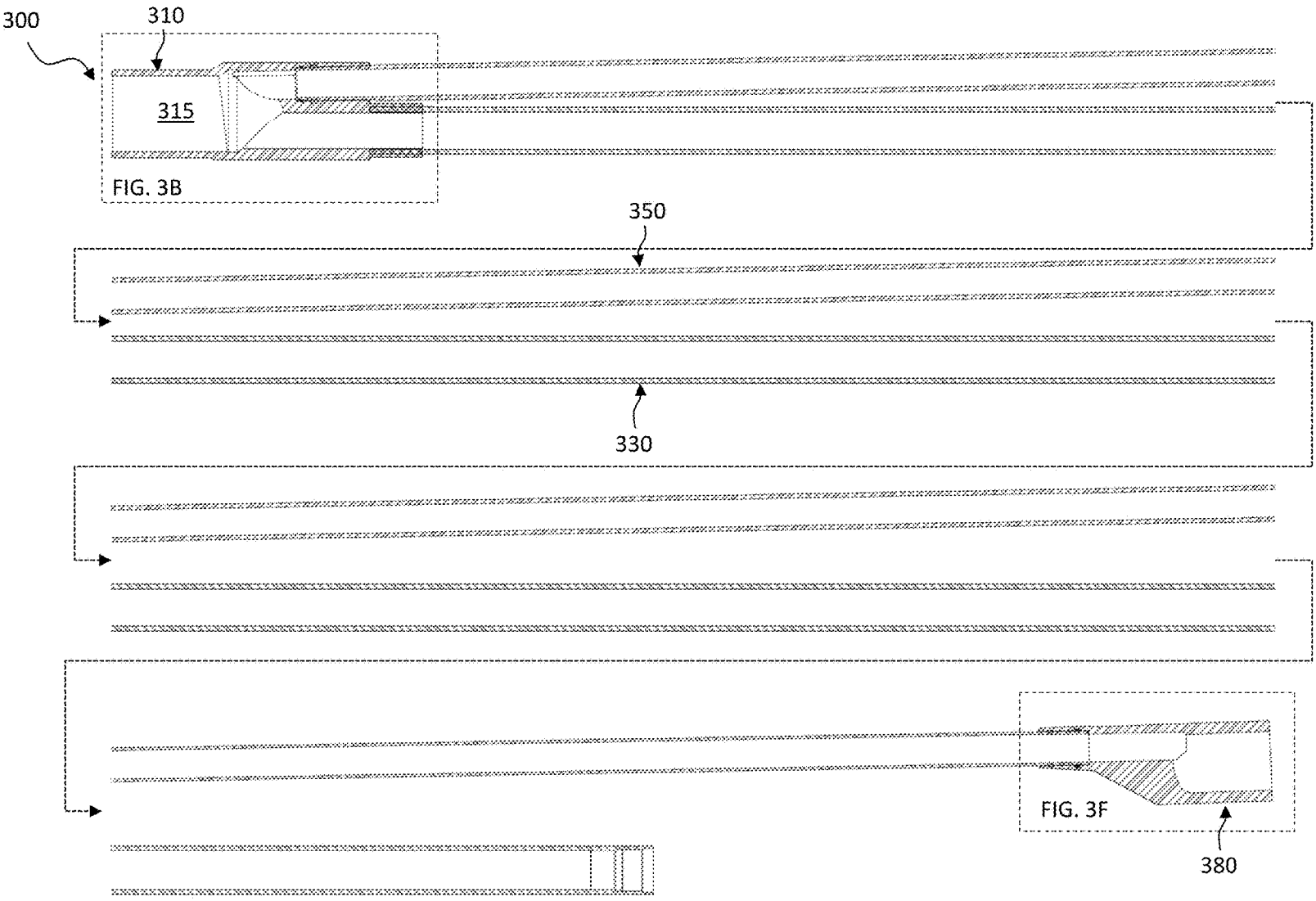
FIGS. 3A through 3G illustrate various different views of one embodiment of a multilateral junction designed, manufactured and/or operated according to one or more embodiments of the disclosure.
Figure 3B:
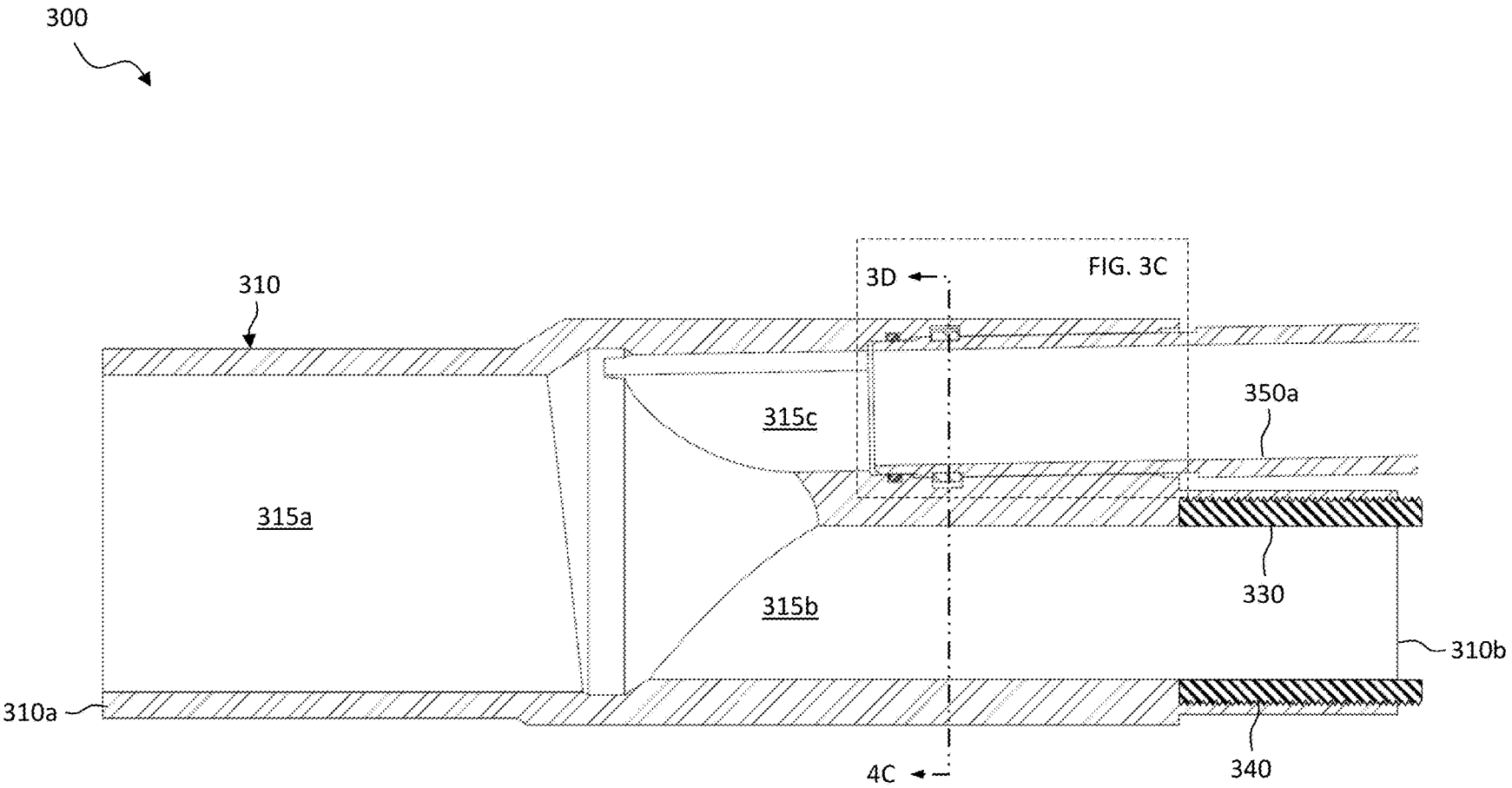
Figure 3C:
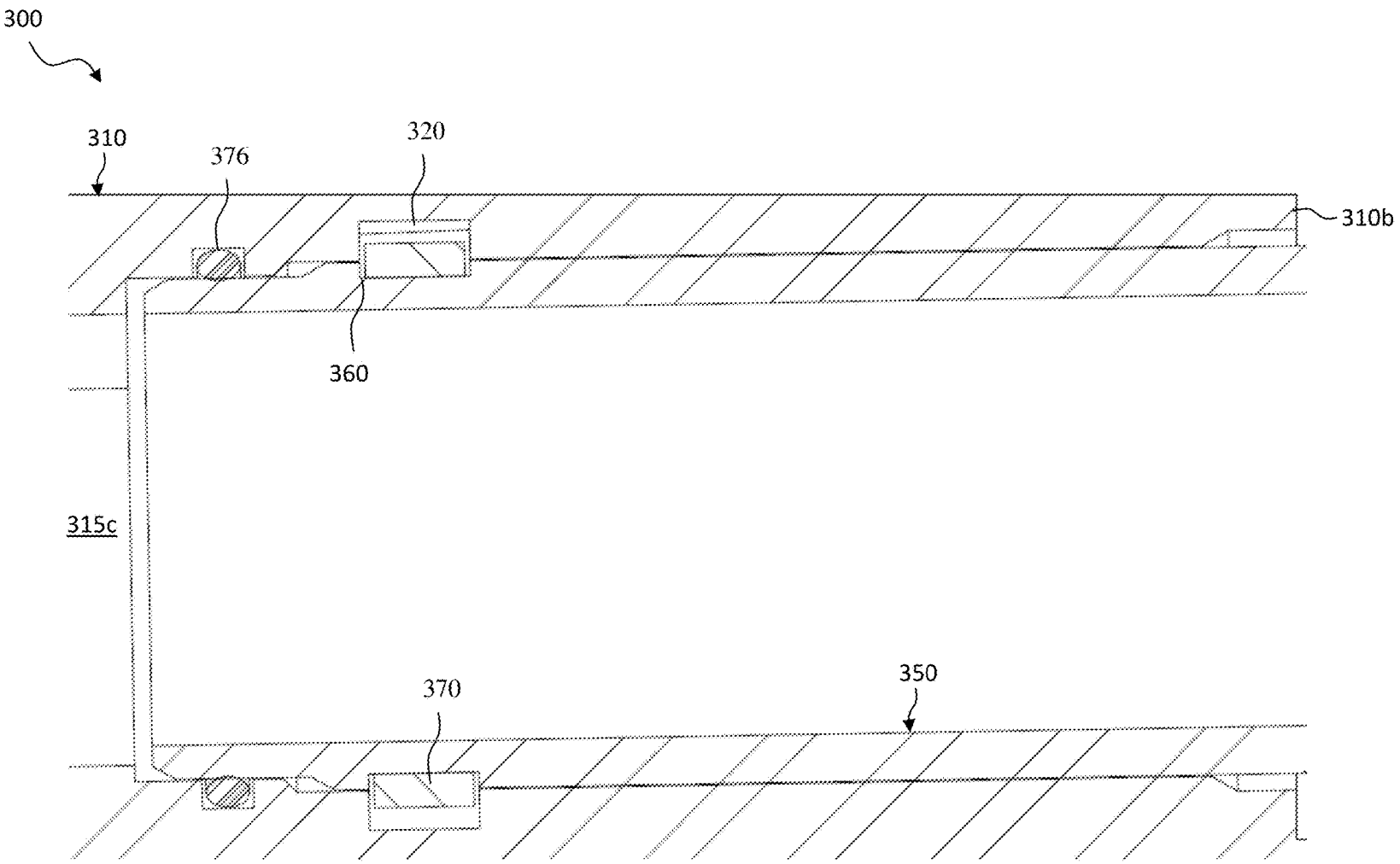

Turning to FIGS. 3A through 3G, illustrated are various different views of one embodiment of a multilateral junction 300 designed, manufactured and/or operated according to one or more embodiments of the disclosure. With initial reference to FIG. 3A, illustrated is a cross-sectional view of the multilateral junction 300. In accordance with one embodiment, the multilateral junction 300 includes a novel housing, a novel tubular engaged with the housing, and an arced coupling or toothed coupling axially fixing the novel housing and the novel tubular. The arced coupling or toothed coupling, as will be discussed below, may be used to axially fix the novel housing and novel tubular together, for example in those situations wherein a threaded connection is not possible and/or feasible. Moreover, the arced coupling or toothed coupling may be employed to axially fix any bore and any tubular of the multilateral junction 300.

The multilateral junction 300, in the illustrated embodiment, includes a y-block 310, a main bore leg 330, a lateral bore leg 350, and a lateral completion engagement sub 380. While not shown in many of the views of FIGS. 3A through 3G, the lateral bore leg 350 may collectively include a first lateral bore leg 350*a* and a second lateral bore leg 350*b* (e.g., if not even third, fourth, etc. lateral bore legs). The novel housing, novel tubular, and arced coupling and/or toothed coupling will be discussed in various different embodiments with regard to the features of the y-block 310, the main bore leg 330, the lateral bore leg 350, and the lateral completion engagement sub 380. For example, the novel housing, in one or more embodiments, is the y-block 310. In yet another embodiment, the novel housing is the lateral completion engagement sub 380, both of which will be discussed below.

Turning initially to FIGS. 3A through 3E, the y-block 310 includes a first housing end 310*a* and a second housing end 310*b*. The y-block 310, in at least this embodiment, further includes a bore 315 extending therethrough from the first housing end 310*a* to the second housing end 310*b*. In at least one embodiment, the bore 315 comprises a single first bore 315*a* extending into the y-block from the first housing end 310*a*, and second and third bores 315*b*, 315*c* branching off from the single first bore 315*a* and exiting the y-block 310 at the second housing end 310*b*. In yet another embodiment, such as that shown, the bore further includes a fourth bore 315*d* branching off from the single first bore 315 and exiting the y-block 310 at the second housing end 310*b* (e.g., somewhat similarly shaped as the third bore 315*c*). The second bore 315*b*, in the illustrated embodiment, is a main leg bore. The third bore 315*c*, in the illustrated embodiment is a first lateral leg bore, and the fourth bore 315*d*, in the illustrated embodiment is a second lateral leg bore.

In accordance with one embodiment of the disclosure, the bore 315 has a bore coupling profile 320 located along an inside surface of the bore 315 proximate the second housing end 310*b*. The bore coupling profile 320, in at least one embodiment, is a 360 degree groove formed in the inside surface of the bore 315. While the bore coupling profile 320 is illustrated in the third bore 315*c* in the embodiment of FIGS. 3A through 3E, other embodiments may exist wherein it is in the single first bore 315*a*, second bore 315*b*, fourth bore 315*d*, or any combination of the single first bore 315*a*, second bore 315*b*, third bore 315*c* and/or fourth bore 315*d*.

In the illustrated embodiments of FIGS. 3A through 3E, the main bore leg 330 extends into the second bore 315*b*, whereas the first lateral bore leg 350*a* extends into the third bore 315*c* and the second lateral bore leg 350*b* extends into the fourth bore 315*d*. In one or more embodiments, the main bore leg 330 employs threads 340 to threadingly couple with the second bore 315*b* (e.g., main leg bore). In the illustrated embodiment, the lateral bore leg 350 includes a tubular having a first tubular end and a second tubular end. The lateral bore leg 350, in accordance with one embodiment, further includes a tubular coupling profile 360 located along an outside surface of the tubular proximate the first tubular end. The tubular coupling profile 360, in at least one embodiment, is a 360 degree groove formed in the outside surface of the tubular. In certain embodiments, the bore coupling profile 320 and the tubular coupling profile 360 are similarly shaped, for example similarly rectangularly shaped.

Figure 3D:
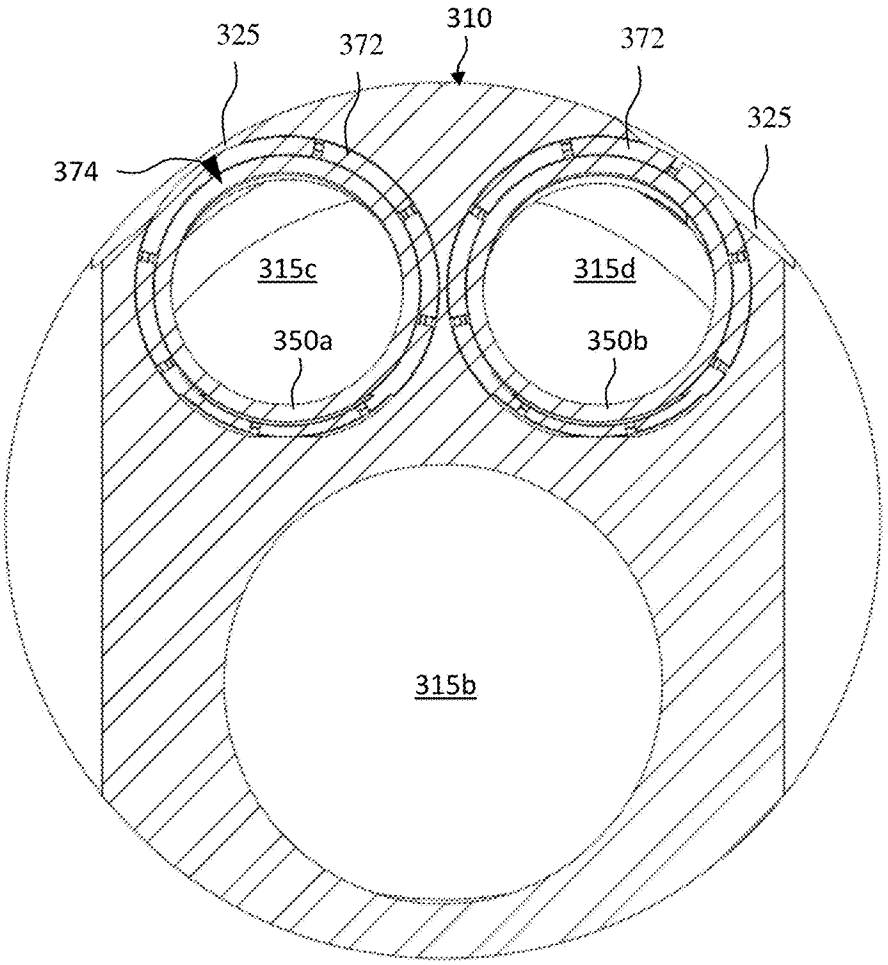
Figure 3E:
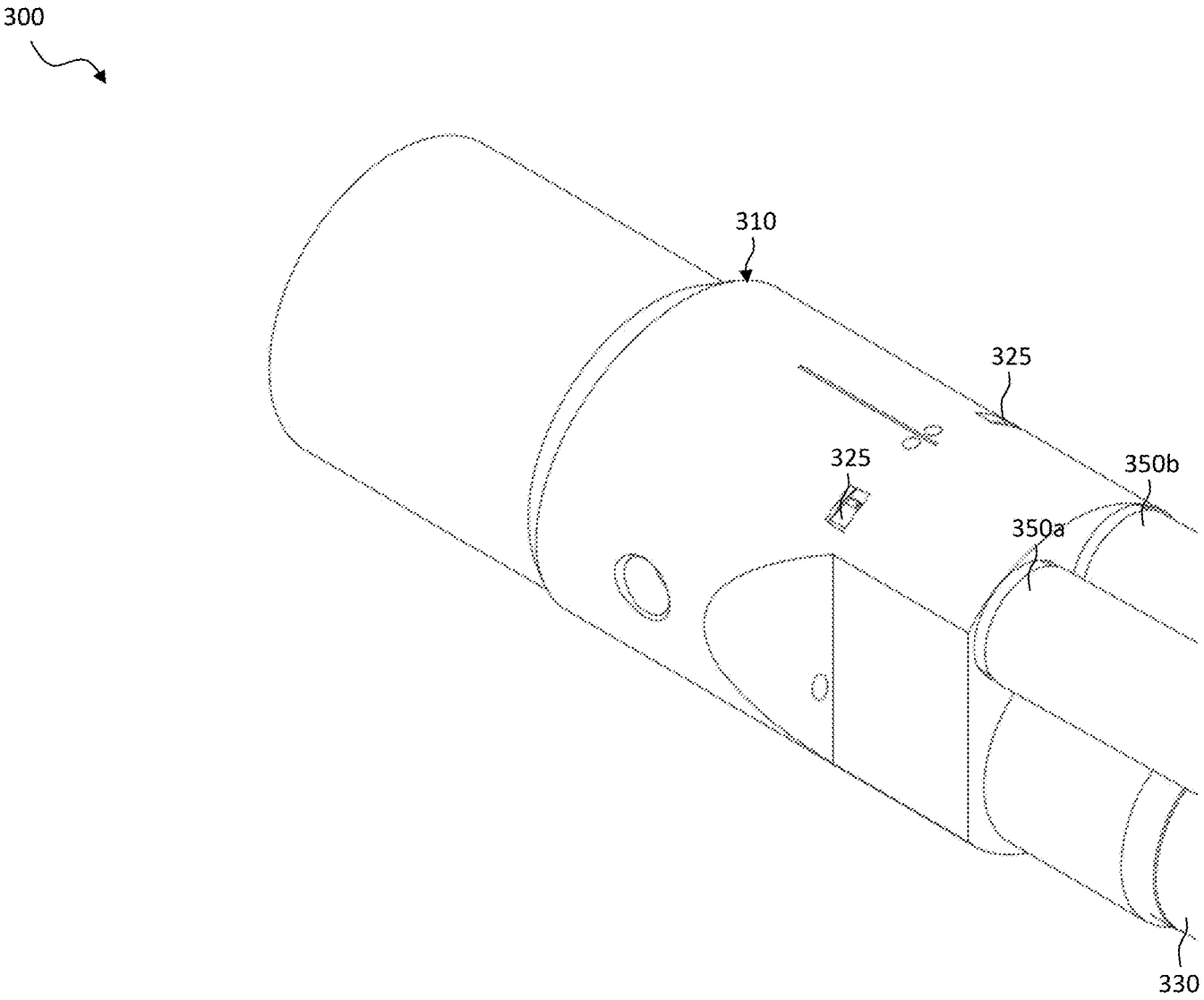

Further to the embodiment of FIGS. 3A through 3E, an arced coupling 370 is located between the third bore 315*c* and the tubular, and engaged with the bore coupling profile 320 and the tubular coupling profile 360 to axially fix the housing (e.g., y-block 310) and the multilateral bore leg (e.g., lateral bore legs 350*a*, 350*b*). The arced coupling 370, in one or more embodiments includes a plurality of separate arced segments 372, such as shown in FIG. 3D. The plurality of separate arced segments 372, may be insert between the third bore 315*c* and the tubular 355, and thus in engagement with the bore coupling profile 320 and the tubular coupling profile 360, via an access port 325 in the housing (e.g., access port in the y-block 310). For example, the plurality of separate arced segments 372 may be sequentially insert and rotated between the third bore 315*c* and the tubular 355 via the access port 325.

In at least one embodiment, a locking member 374 is engageable with the plurality of separate arced segments 372 or the access port 325, the locking member 374 configured to prevent the plurality of arced segments 372 from being removed from the bore coupling profile 320. In at least one embodiment, such as shown in FIG. 3D, the locking member 374 is an anti-rotation screw or wedge. In at least one other embodiment, the locking member 374 is a cover to the access port 325, among other possible solutions. In yet another embodiment, the arced coupling 370 is a collection of one or more C-rings.

The multilateral junction 300, in one or more embodiments, may further include a seal member 376 located between the bore (e.g., third bore 315*c*) and the tubular (e.g., first lateral bore leg 350*a*) and axially positioned between the arced coupling 370 and first tubular end of the tubular (e.g., first lateral bore leg 350*a*). The seal member 376, which may comprise an O-ring positioned within an O-ring groove, provides a fluid tight seal between the bore (e.g., third bore 315*c*) and the tubular (e.g., first lateral bore leg 350*a*).

While the embodiment of FIGS. 3A through 3E have been discussed with regard to the plurality of separate arced segments 372, the arced coupling 370 may comprise various other different shapes and remain within the scope of the disclosure. In at least one embodiment, the arced coupling 370 is a collection of one or more C-rings. In yet another embodiment, the arced coupling is a wire of pliable material that may be insert within the access port 325 and follow the shaped of the bore coupling profile and tubular coupling profile to axially fix the housing and the multilateral bore leg relative to one another.

Figure 3F:
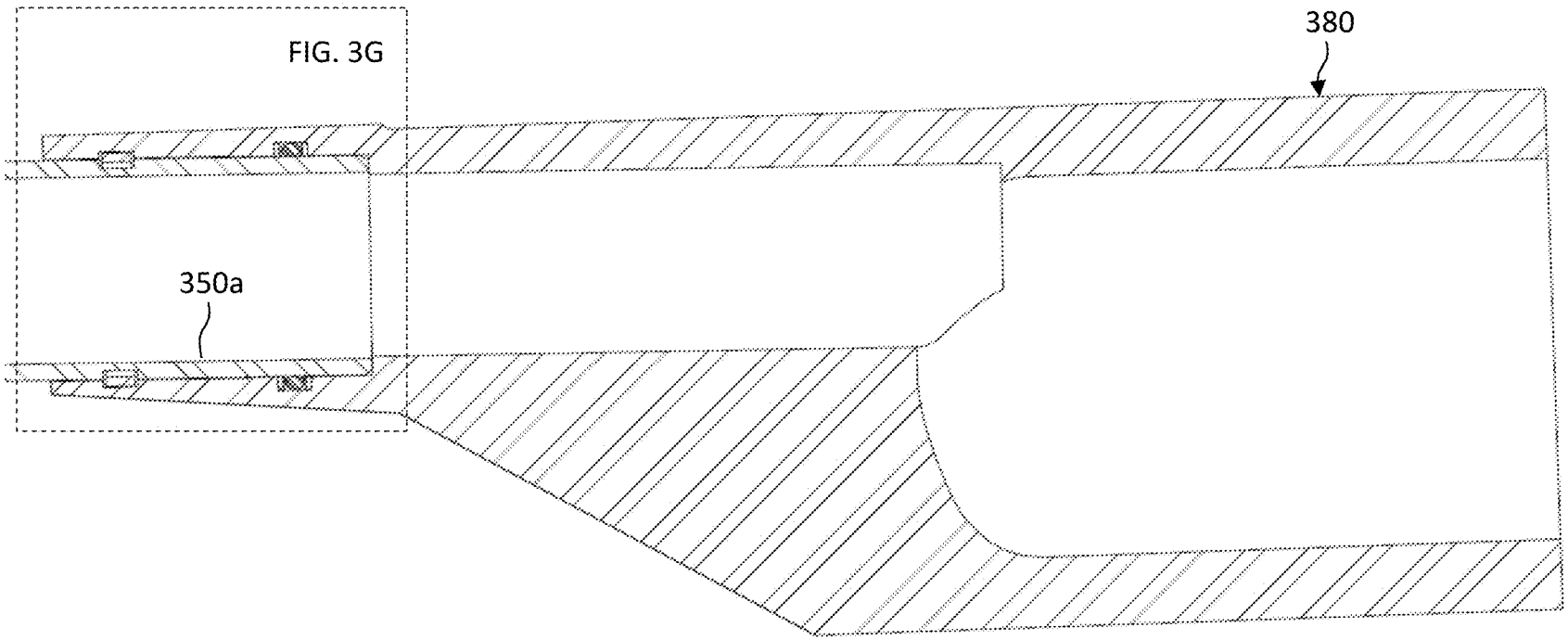
Figure 3G:
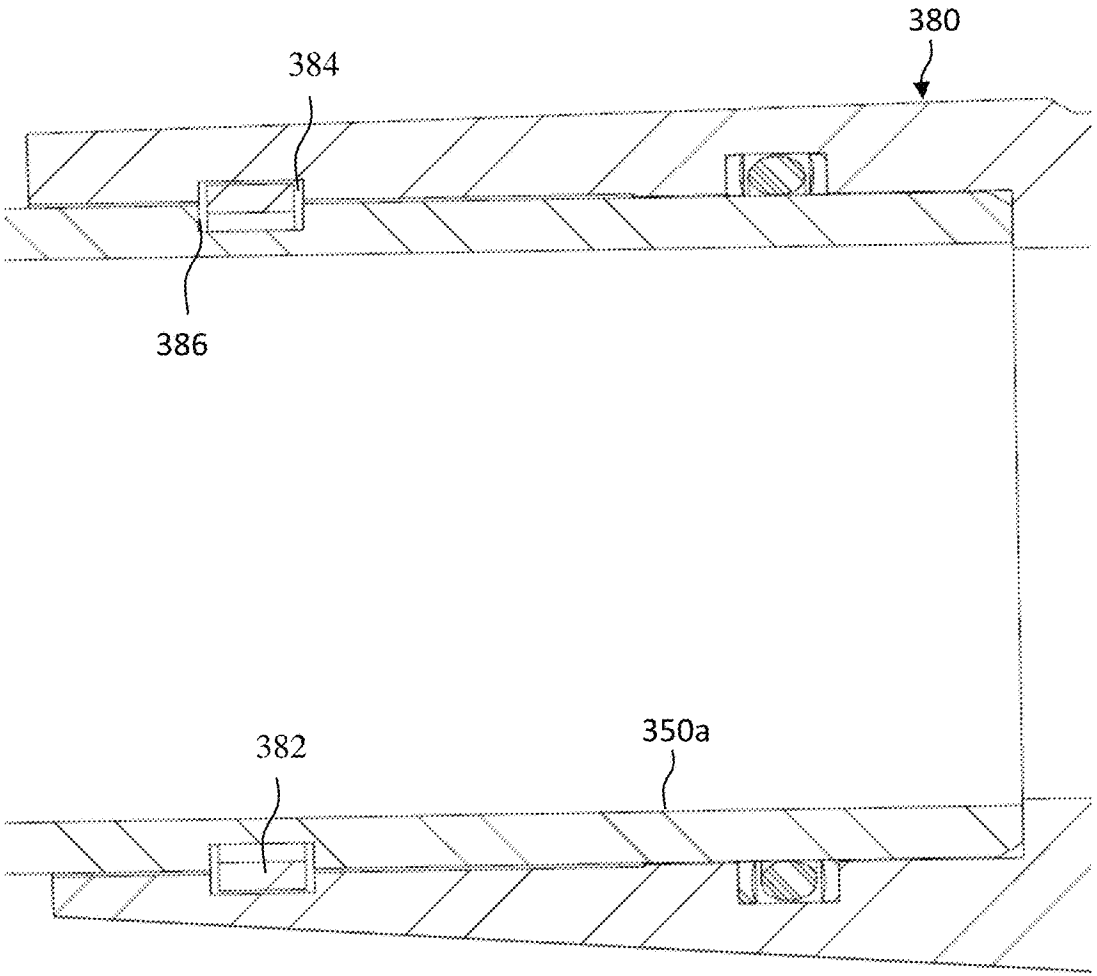

Turning to FIGS. 3F and 3G, illustrated is an alternative embodiment employing an arced coupling 382, bore coupling profile 384 and tubular coupling profile 386 to axially fix the lateral completion engagement sub 380 to the first and/or second lateral bore legs 350*a*, 350*b*. The process for axially fixing the lateral completion engagement sub 380 to the first and/or second lateral bore legs 350*a*, 350*b* is similar to the process for axially fixing the y-block 310 to the first and/or second lateral bore legs 350*a*, 350*b*. Accordingly, greater detail for such an embodiment may be found in the paragraphs above.

Figure 4A:
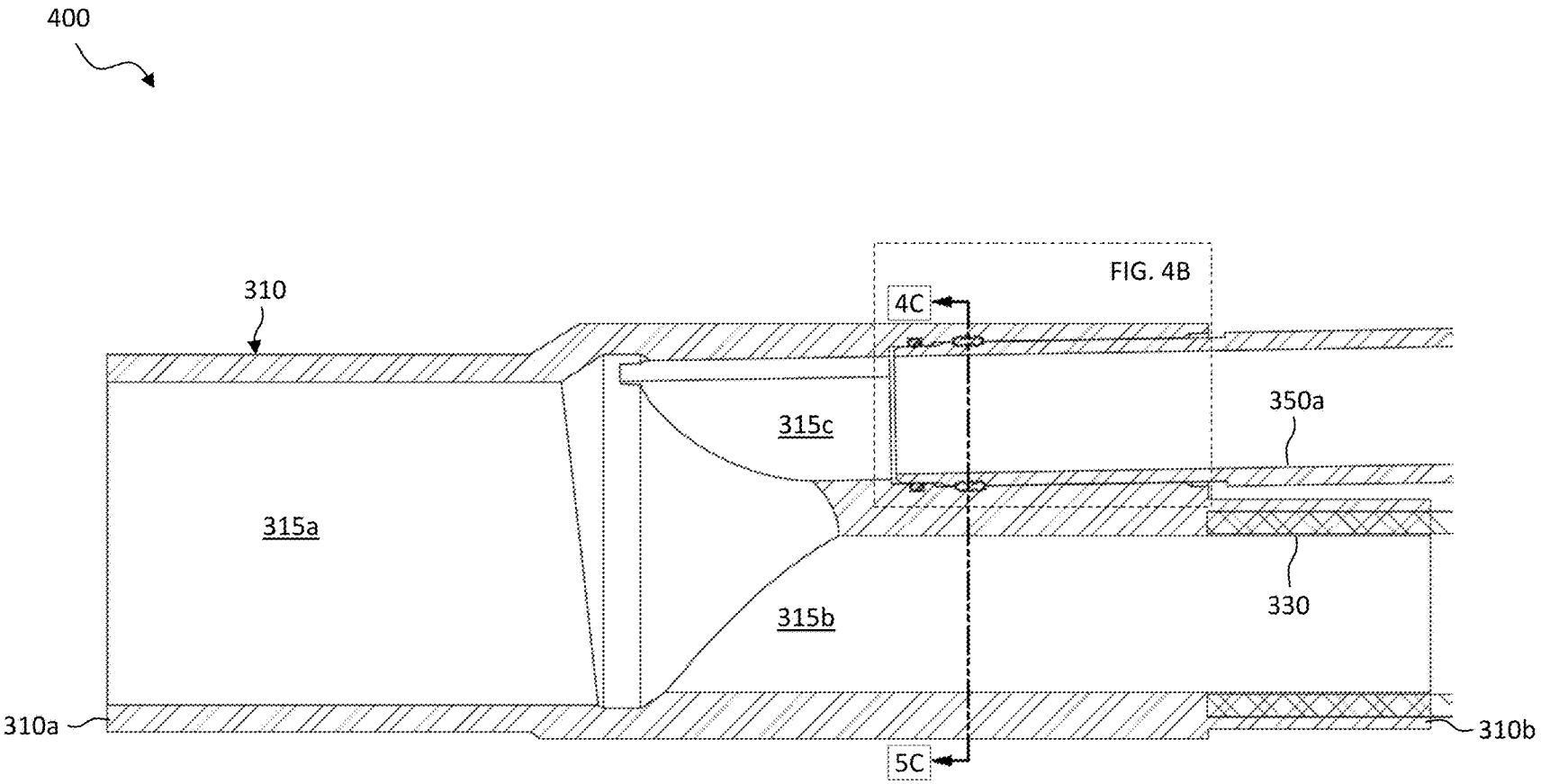
FIGS. 4A through 4C illustrate different views of an alternative embodiment of a multilateral junction designed, manufactured and/or operated according to one or more different embodiments of the disclosure.
Figure 4B:
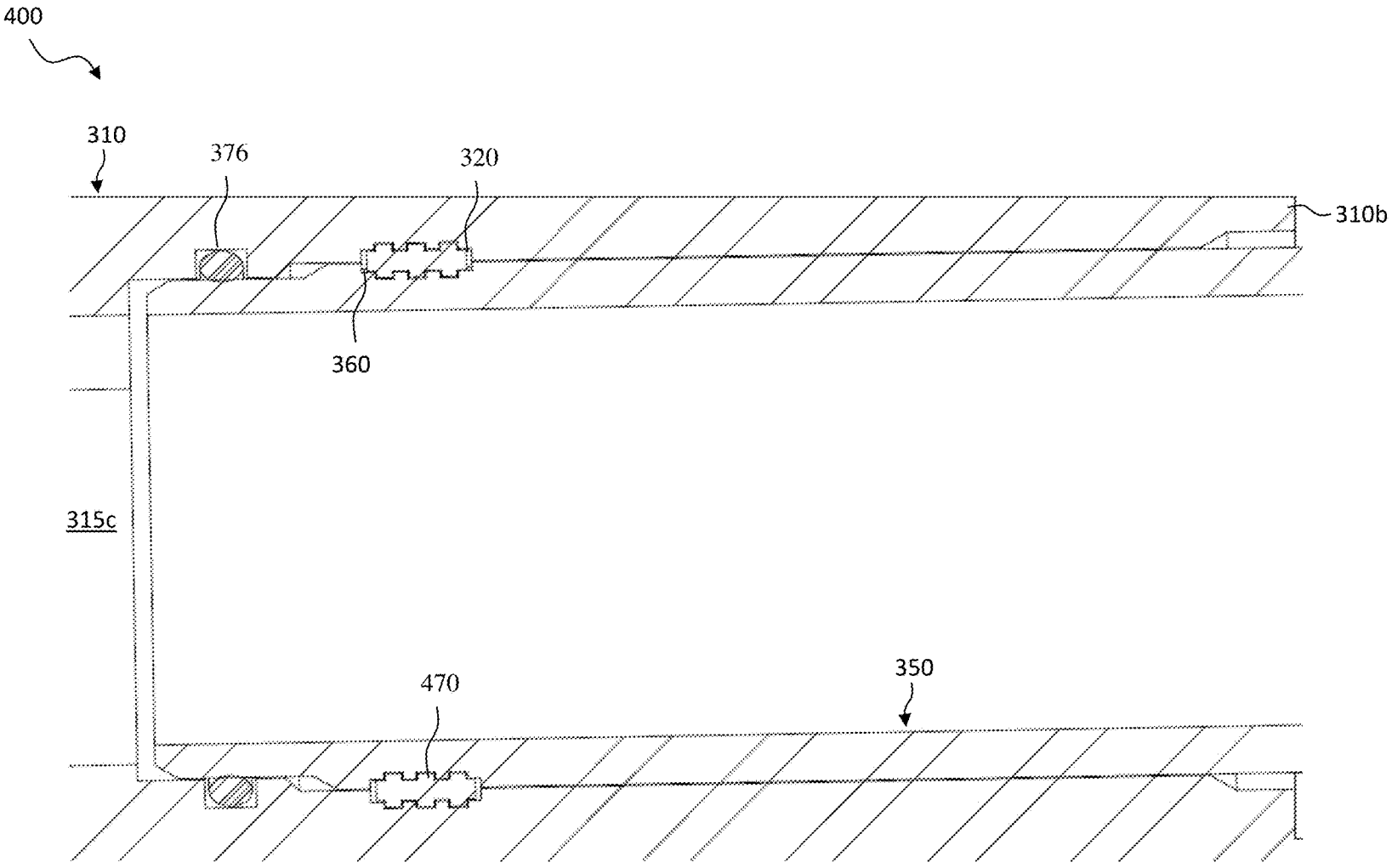
Figure 4C:
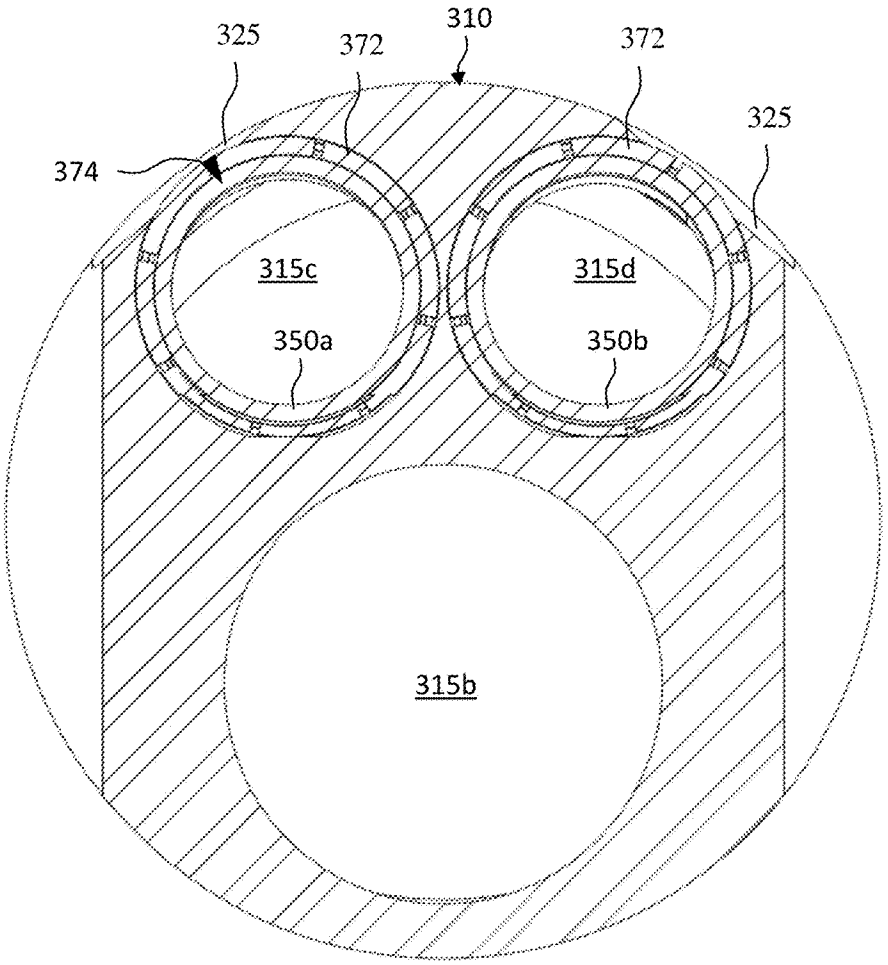

Turning to FIGS. 4A through 4C, illustrated are different views of an alternative embodiment of a multilateral junction 400 designed, manufactured and/or operated according to one or more different embodiments of the disclosure. The multilateral junction 400 is similar in many respects to the multilateral junction 300. Accordingly, like reference numbers have been used to indicated similar, if not identical, features. The multilateral junction 400 differs, for the most part, from the multilateral junction 300, in that the multilateral junction 400 employs an arced coupling 470 having a toothed cross-section, whereas the multilateral junction 300 employs its arced coupling 370 having a rectangular cross-section. The toothed cross-section may be used to improve the axial coupling between the housing and the tubular. In at least one embodiment, the toothed cross-section is a non-helical thread, among other possible shapes.

Figure 5A:
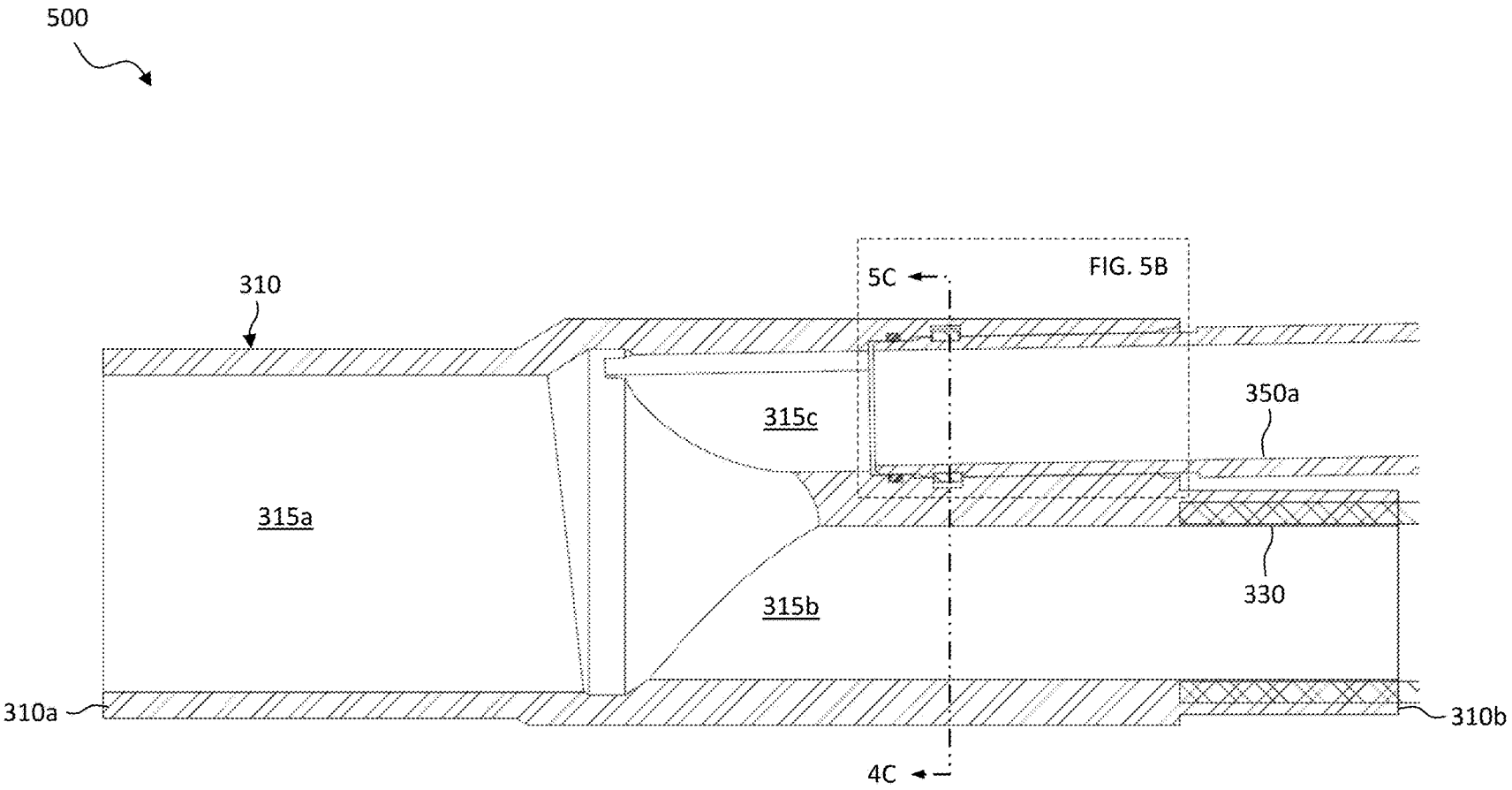
FIGS. 5A through 5C illustrate different views of an alternative embodiment of a multilateral junction designed, manufactured and/or operated according to one or more different embodiments of the disclosure.
Figure 5B:
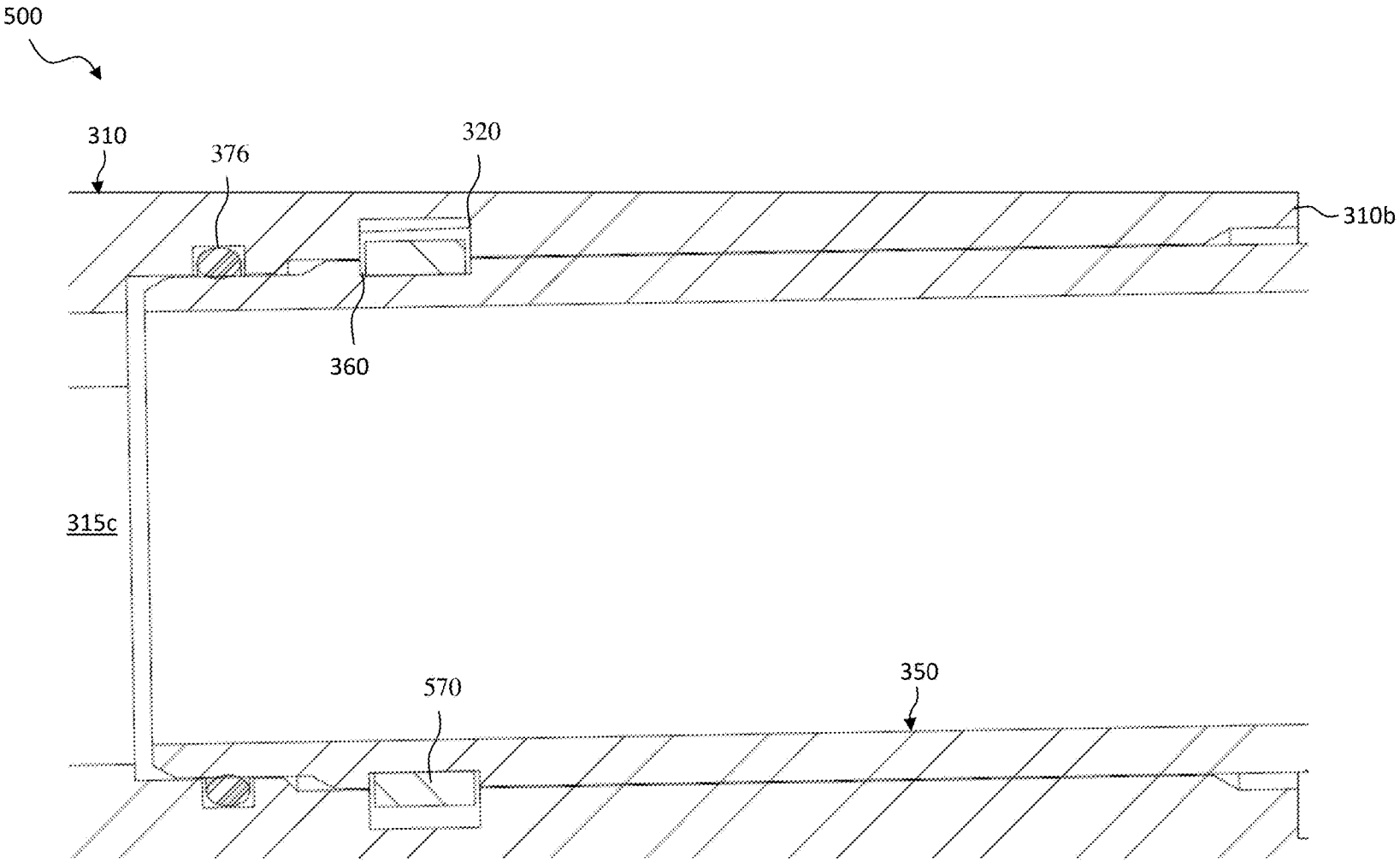
Figure 5C:
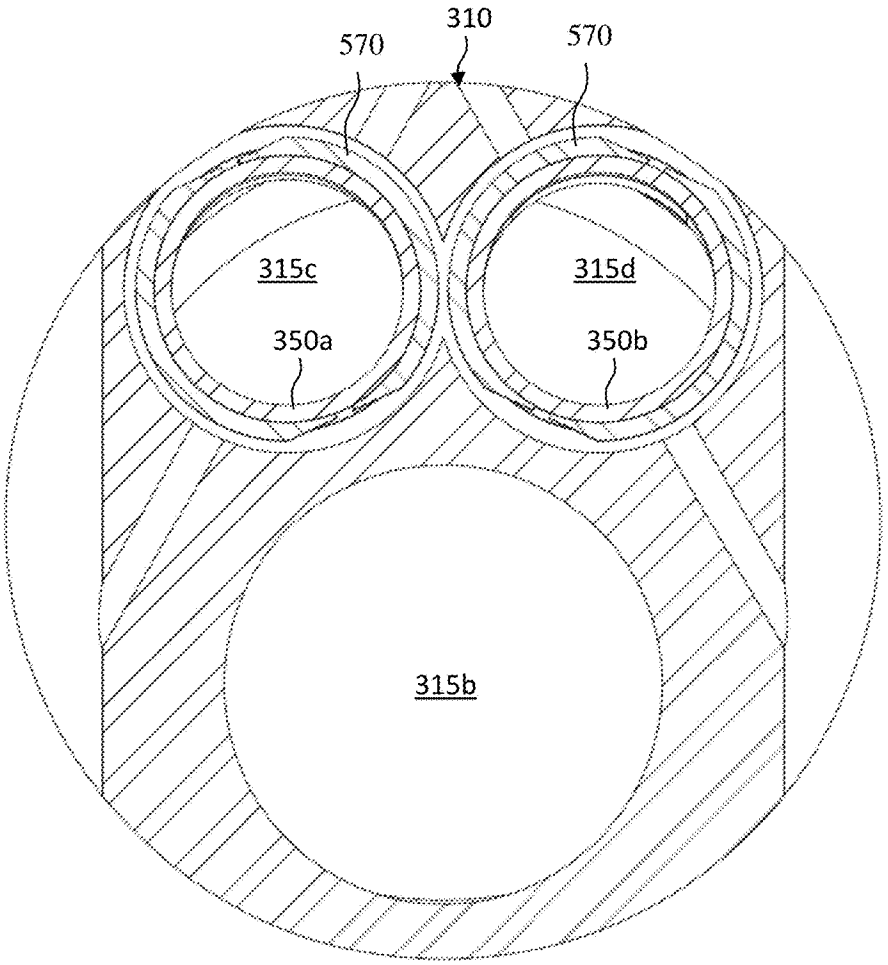

Turning to FIGS. 5A through 5C, illustrated are different views of an alternative embodiment of a multilateral junction 500 designed, manufactured and/or operated according to one or more different embodiments of the disclosure. The multilateral junction 500 is similar in many respects to the multilateral junction 300. Accordingly, like reference numbers have been used to indicated similar, if not identical, features. The multilateral junction 500 differs, for the most part, from the multilateral junction 300, in that the multilateral junction 500 employs an arced coupling 570 comprising a snap ring. In the embodiment of FIGS. 5A through 5C, the arced coupling 570 is a snap ring that resides in the bore coupling profile 320 and snaps inward into the tubular coupling profile 360 when the multilateral bore leg 350 is insert within the bore. In an alternative embodiment, the arced coupling 570 is a snap ring that resides in the tubular coupling profile 360 and snaps outward into the bore coupling profile 320 when the multilateral bore leg 350 is insert within the bore.

Figure 6A:
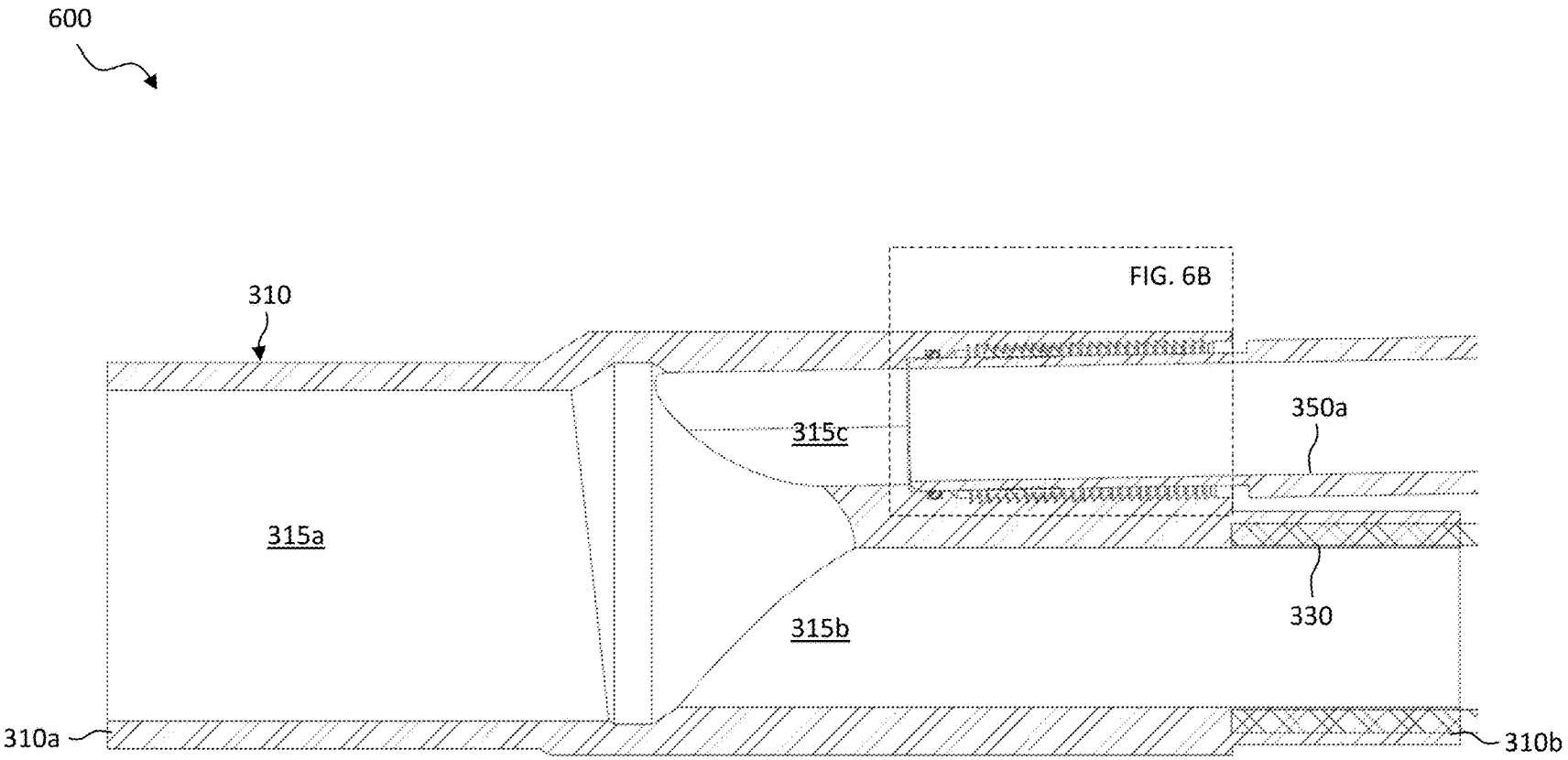
FIGS. 6A and 6B illustrate different views of an alternative embodiment of a multilateral junction designed, manufactured and/or operated according to one or more different embodiments of the disclosure.
Figure 6B:
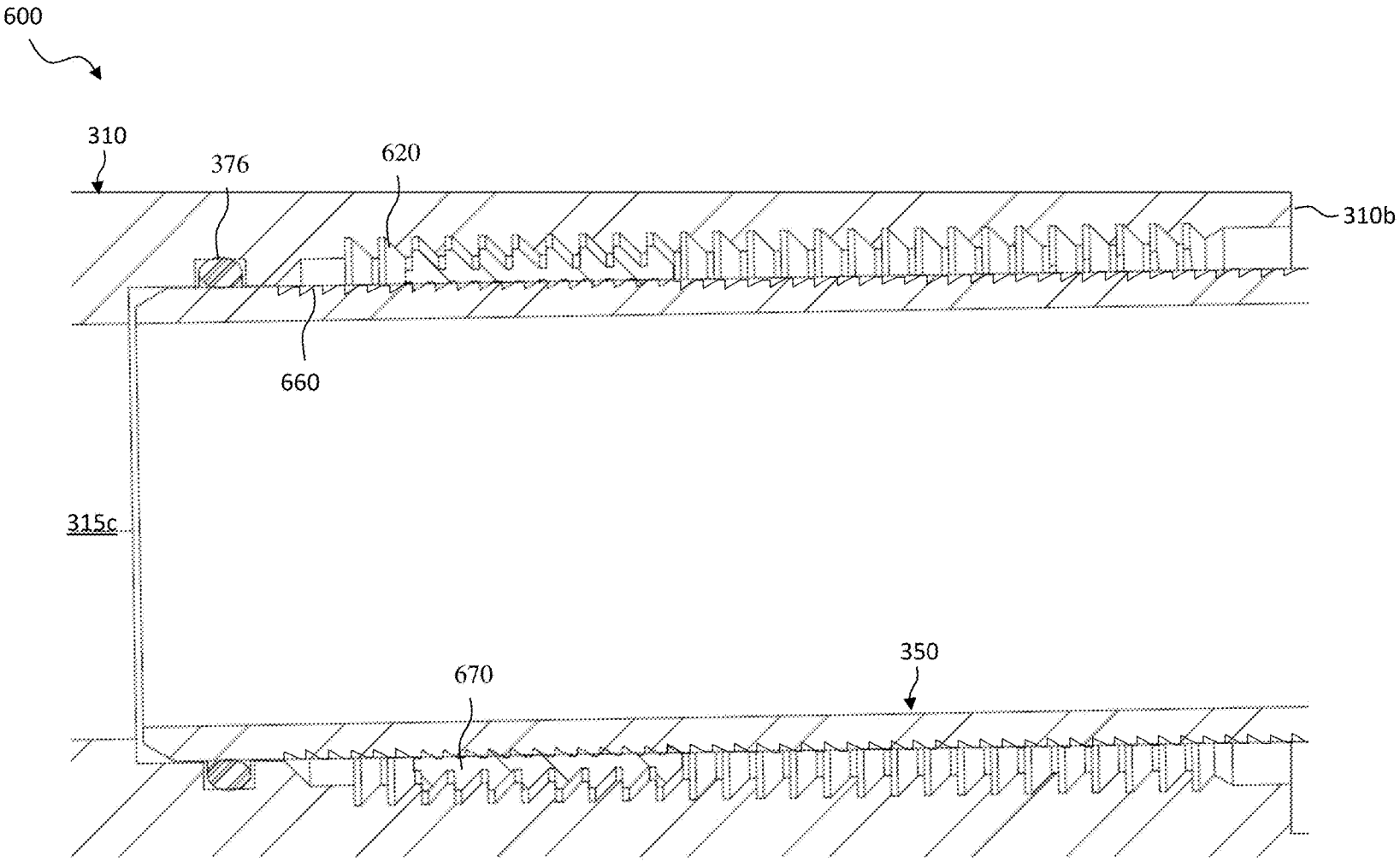

Turning to FIGS. 6A and 6B, illustrated are different views of an alternative embodiment of a multilateral junction 600 designed, manufactured and/or operated according to one or more different embodiments of the disclosure. The multilateral junction 600 is similar in many respects to the multilateral junction 300. Accordingly, like reference numbers have been used to indicated similar, if not identical, features. The multilateral junction 600 differs, for the most part, from the multilateral junction 300, in that the multilateral junction 600 employs a toothed coupling 670 to axially fix the y-block 310 to the multilateral bore leg 350. In at least one embodiment, a toothed coupling profile 620 is located along an inside surface thereof, the toothed coupling profile 620 engageable (e.g., rachetable) with respect to the toothed coupling 670 to axially fix the y-block 310 to the multilateral bore leg 350. In certain other embodiments, the multilateral bore leg 350 further includes a second toothed coupling profile 660 located along an outside surface of the tubular proximate the first tubular end. According to this embodiment, the toothed coupling 670 is located between the bore 315*c* and the tubular and engaged with the toothed coupling profile 620 and the second toothed coupling profile 660 to axially fix the y-block 310 and the multilateral bore leg 350 relative to one another.

In one or more embodiments, the toothed coupling 670 has directionally angled teeth that allow the multilateral bore leg 350 to be insert within the bore 315*c* of the y-block 310 while preventing the multilateral bore leg 350 from being removed from the bore 315*c*. In yet other embodiments, the toothed coupling 670 is a lock ring that is configured to ratchet onto the tubular when the multilateral bore leg 350 is being insert within the bore 315*c*. In even yet another embodiment, the toothed coupling 670 is a C-ring or a collet, among other arc shaped features. It should be noted that while the embodiment of FIGS. 6A and 6B are being described as using the toothed coupling with the y-block 310, other embodiments could also use the toothed coupling 670 with a lateral completion engagement sub or another feature where a threaded connection is not possible and/or feasible.

Figure 7:
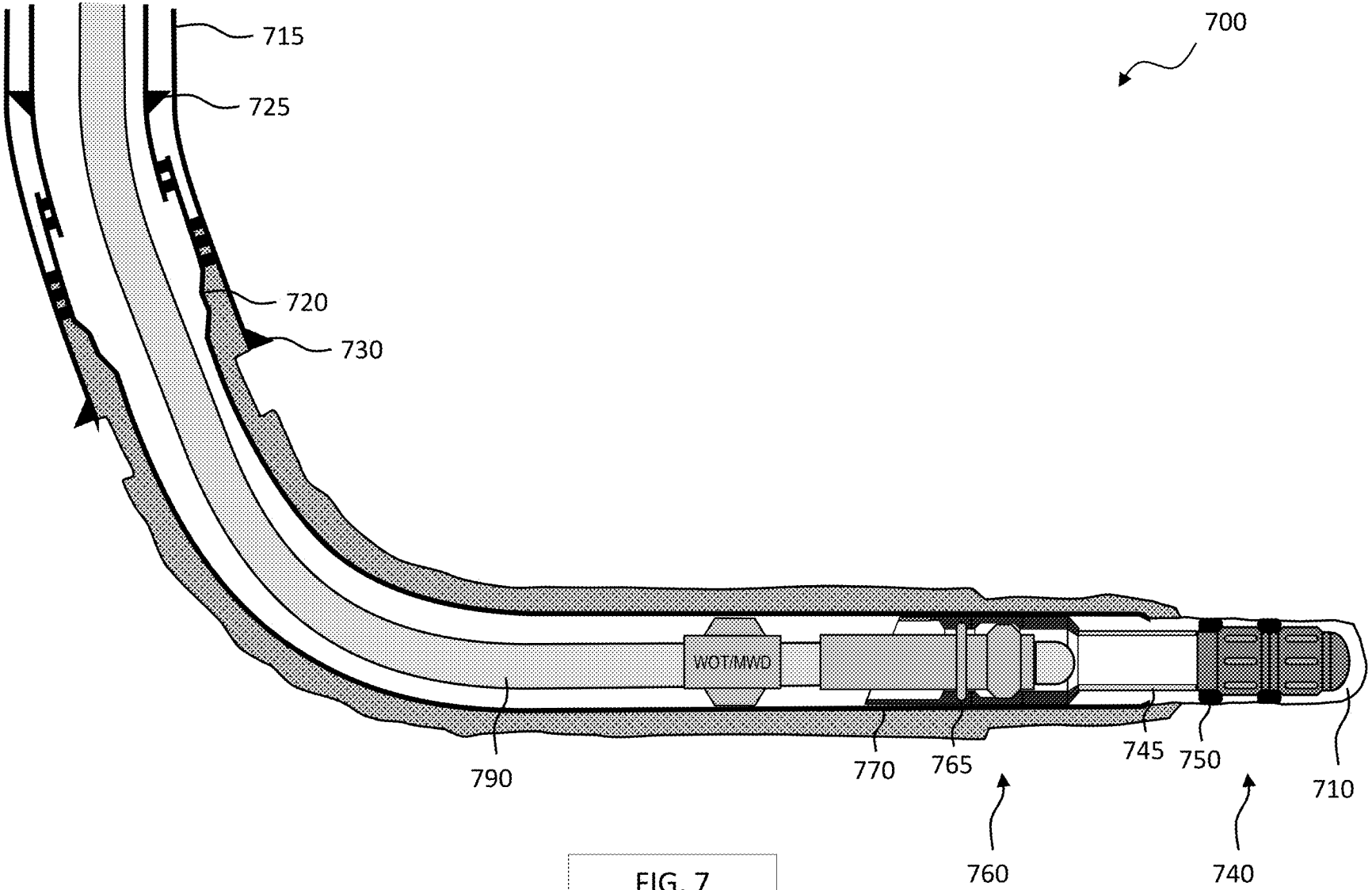
FIGS. 7 through 19 illustrate a method for forming, fracturing and/or producing from a well system including a multilateral junction according to the disclosure.

Turning now to FIGS. 7 through 19, illustrated is a method for forming, accessing, potentially fracturing, and producing from a well system 700. FIG. 7 is a schematic of the well system 700 at the initial stages of formation. A main wellbore 710 may be drilled, for example by a rotary steerable system at the end of a drill string and may extend from a well origin (not shown), such as the earth's surface or a sea bottom. The main wellbore 710 may be lined by one or more casings 715, 720, each of which may be terminated by a shoe 725, 730.

The well system 700 of FIG. 7 additionally includes a main wellbore completion 740 positioned in the main wellbore 710. The main wellbore completion 740 may, in certain embodiments, include a main wellbore liner 745 (e.g., with frac sleeves in one embodiment), as well as one or more packers 750 (e.g., swell packers in one embodiment). The main wellbore liner 745 and the one or more packer 750 may, in certain embodiments, be run on an anchor system 760. The anchor system 760, in one embodiment, includes a collet profile 765 for engaging with the running tool 790, as well as a muleshoe 770 (e.g., slotted alignment muleshoe). A standard workstring orientation tool (WOT) and/or measurement while drilling (MWD) tool may be coupled to the running tool 790, and thus be used to orient the anchor system 760.

Figure 8:
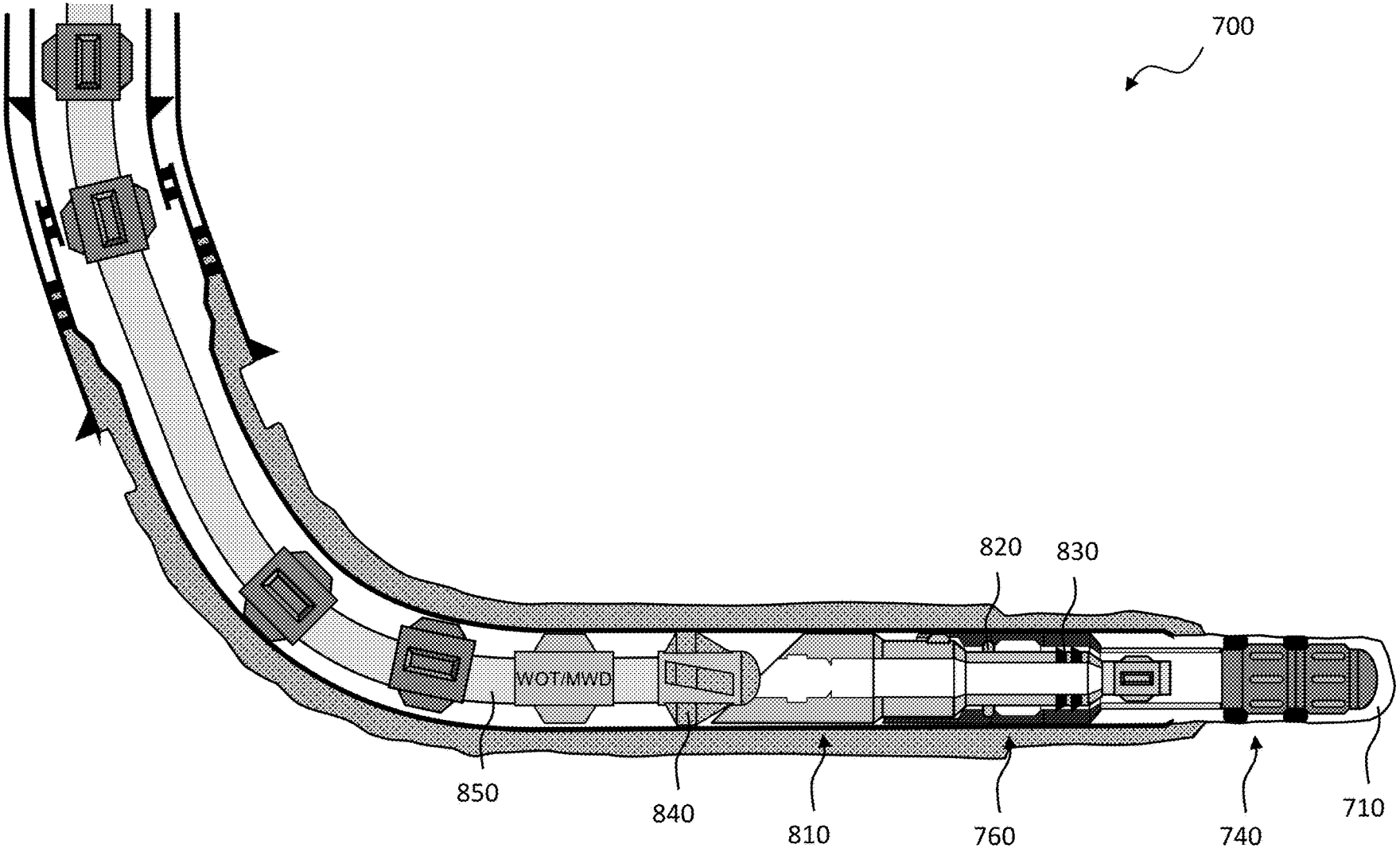

Turning to FIG. 8, illustrated is the well system 700 of FIG. 7 after positioning a whipstock assembly 810 downhole at a location where a lateral wellbore is to be formed. The whipstock assembly 810 in at least one embodiment includes a collet 820 for engaging the collet profile 765 in the anchor system 760. The whipstock assembly 810 additionally includes one or more seals 830 (e.g., a wiper set in one embodiment) to seal the whipstock assembly 810 with the main wellbore completion 740. In certain embodiments, such as that shown in FIG. 8, the whipstock assembly 810 is made up with a lead mill 840, for example using a shear bolt, and then run in hole on a drill string 850. The WOT/MWD tool may be employed to orient the whipstock assembly 810.

Figure 9:
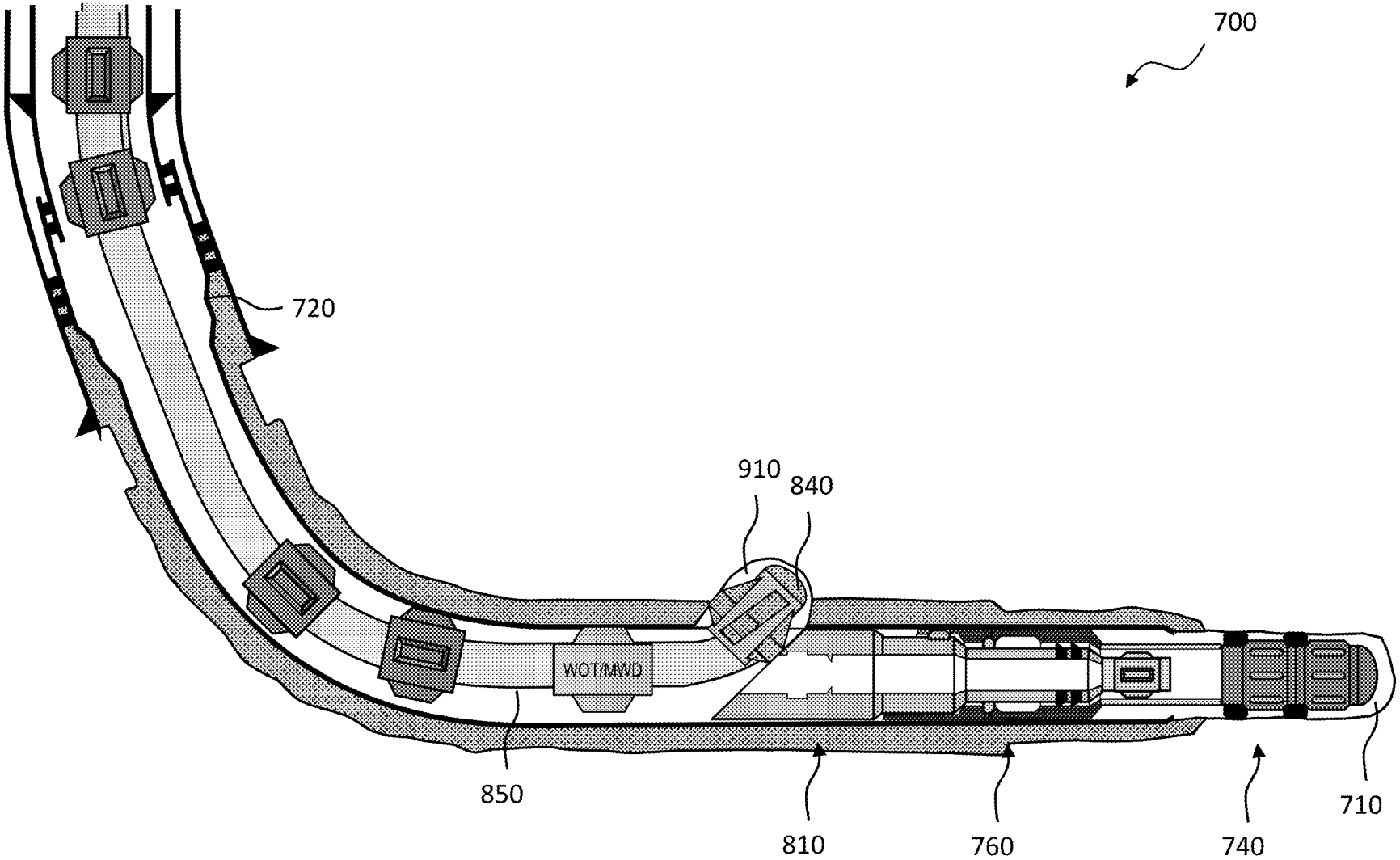

Turning to FIG. 9, illustrated is the well system 700 of FIG. 8 after setting down weight to shear the shear bolt between the lead mill 840 and the whipstock assembly 810, and then milling an initial window pocket 910. In certain embodiments, the initial window pocket 910 is between 1.5 m and 7.0 m long, and in certain other embodiments about 2.5 m long, and extends through the casing 720. Thereafter, a circulate and clean process could occur, and then the drill string 850 and lead mill 840 may be pulled out of hole.

Figure 10:
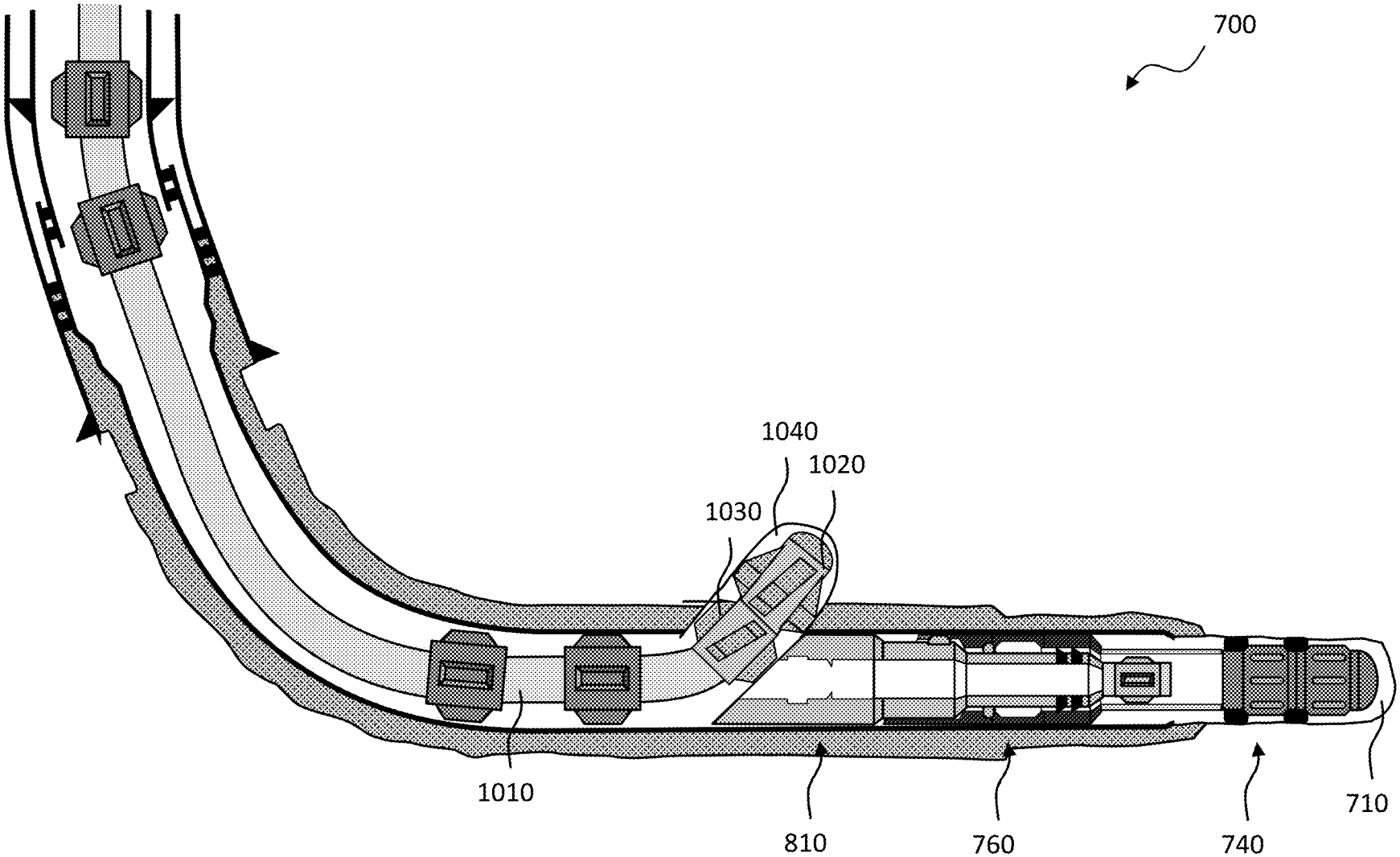

Turning to FIG. 10, illustrated is the well system 700 of FIG. 9 after running a lead mill 1020 and watermelon mill 1030 downhole on a drill string 1010. In the embodiments shown in FIG. 10, the drill string 1010, lead mill 1020 and watermelon mill 1030 drill a full window pocket 1040 in the formation. In certain embodiments, the full window pocket 1040 is between 5 m and 10 m long, and in certain other embodiments about 8.5 m long. Thereafter, a circulate and clean process could occur, and then the drill string 1010, lead mill 1020 and watermelon mill 1030 may be pulled out of hole.

Figure 11:
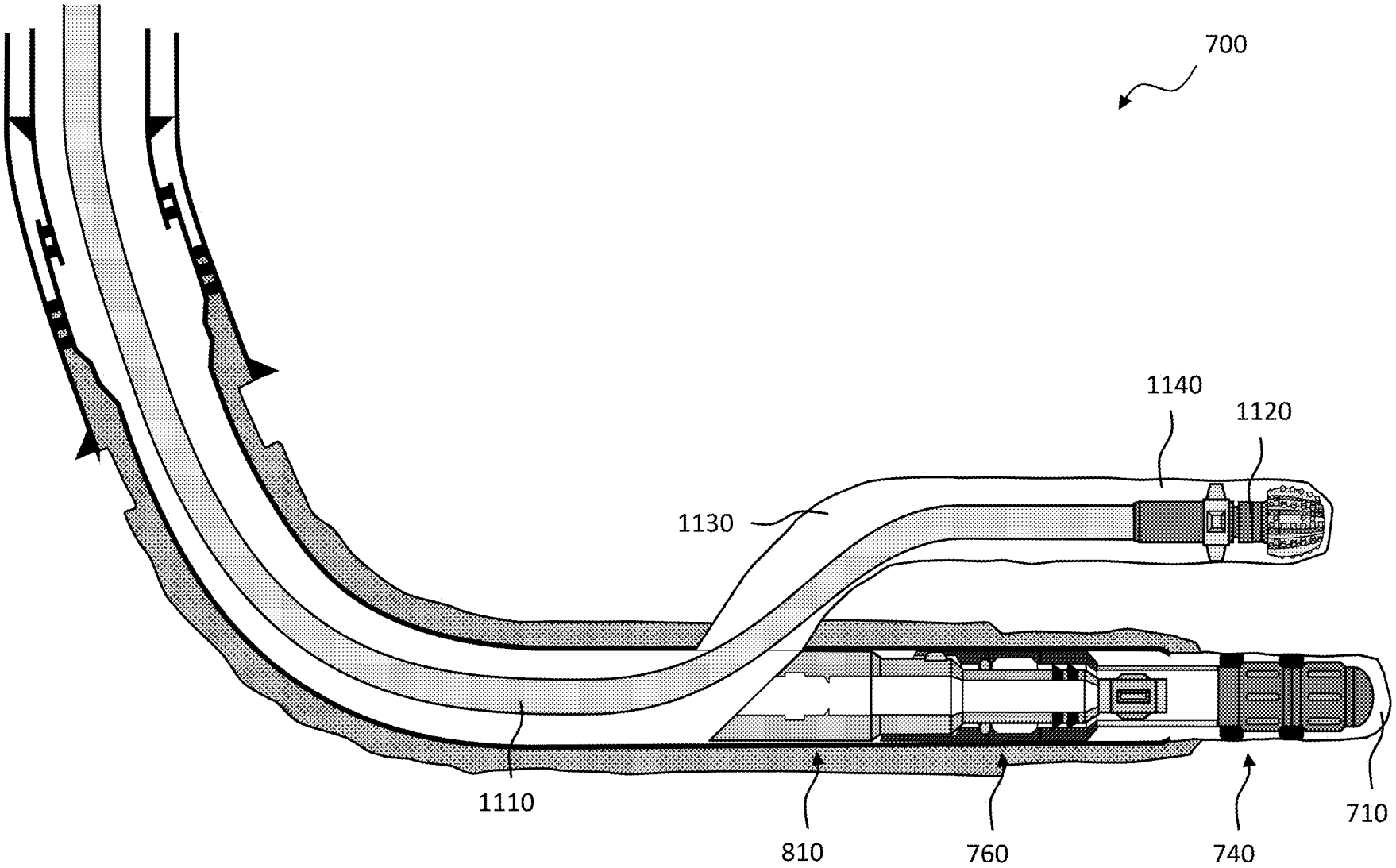

Turning to FIG. 11, illustrated is the well system 700 of FIG. 10 after running in hole a drill string 1110 with a rotary steerable assembly 1120, drilling a tangent 1130 following an inclination of the whipstock assembly 810, and then continuing to drill the lateral wellbore 1140 to depth. Thereafter, the drill string 1110 and rotary steerable assembly 1120 may be pulled out of hole.

Figure 12:
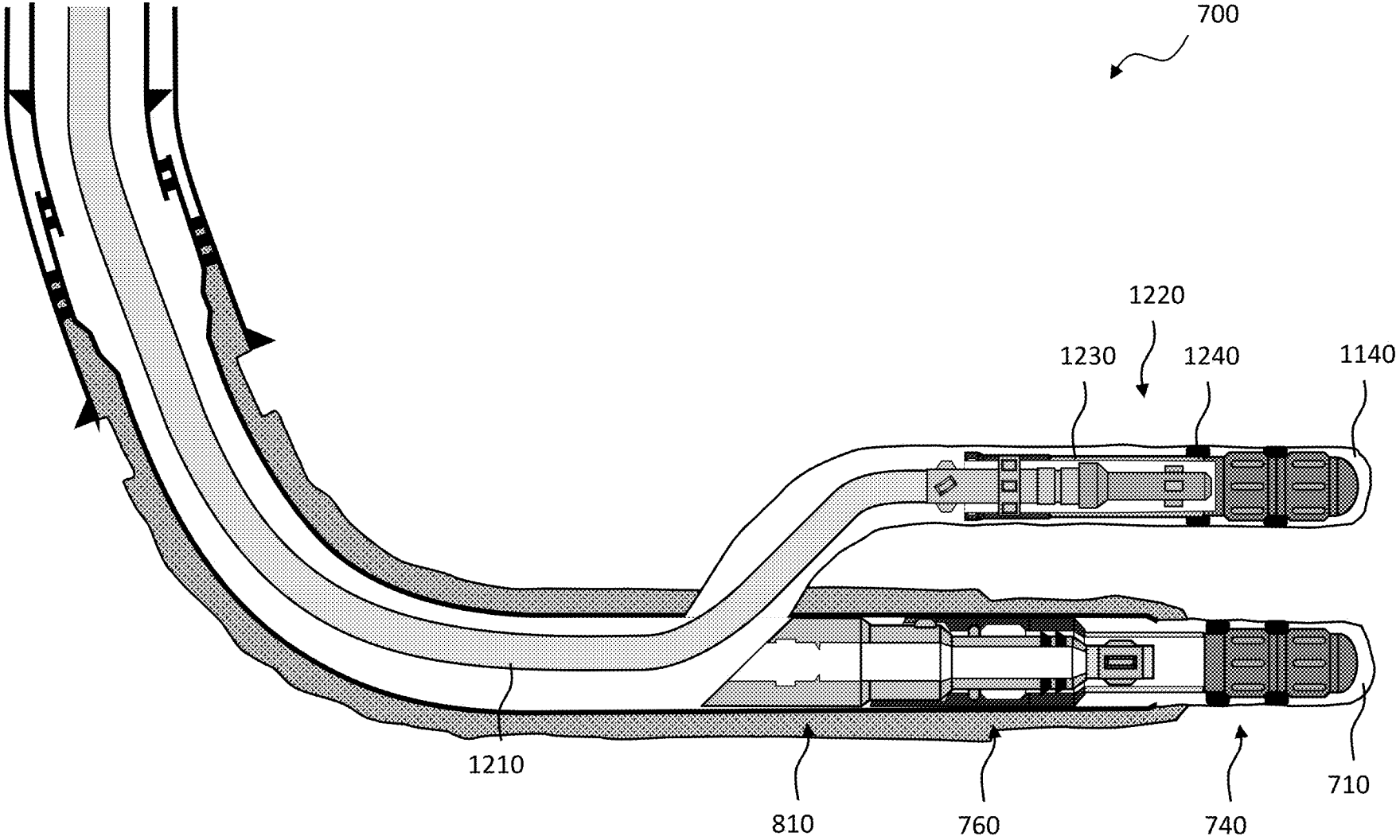

Turning to FIG. 12, illustrated is the well system 700 of FIG. 11 after employing an inner string 1210 to position a lateral wellbore completion 1220 in the lateral wellbore 1140. The lateral wellbore completion 1220 may, in certain embodiments, include a lateral wellbore liner 1230 (e.g., with frac sleeves in one embodiment), as well as one or more packers 1240 (e.g., swell packers in one embodiment). Thereafter, the inner string 1210 may be pulled into the main wellbore 710 for retrieval of the whipstock assembly 810.

Figure 13:
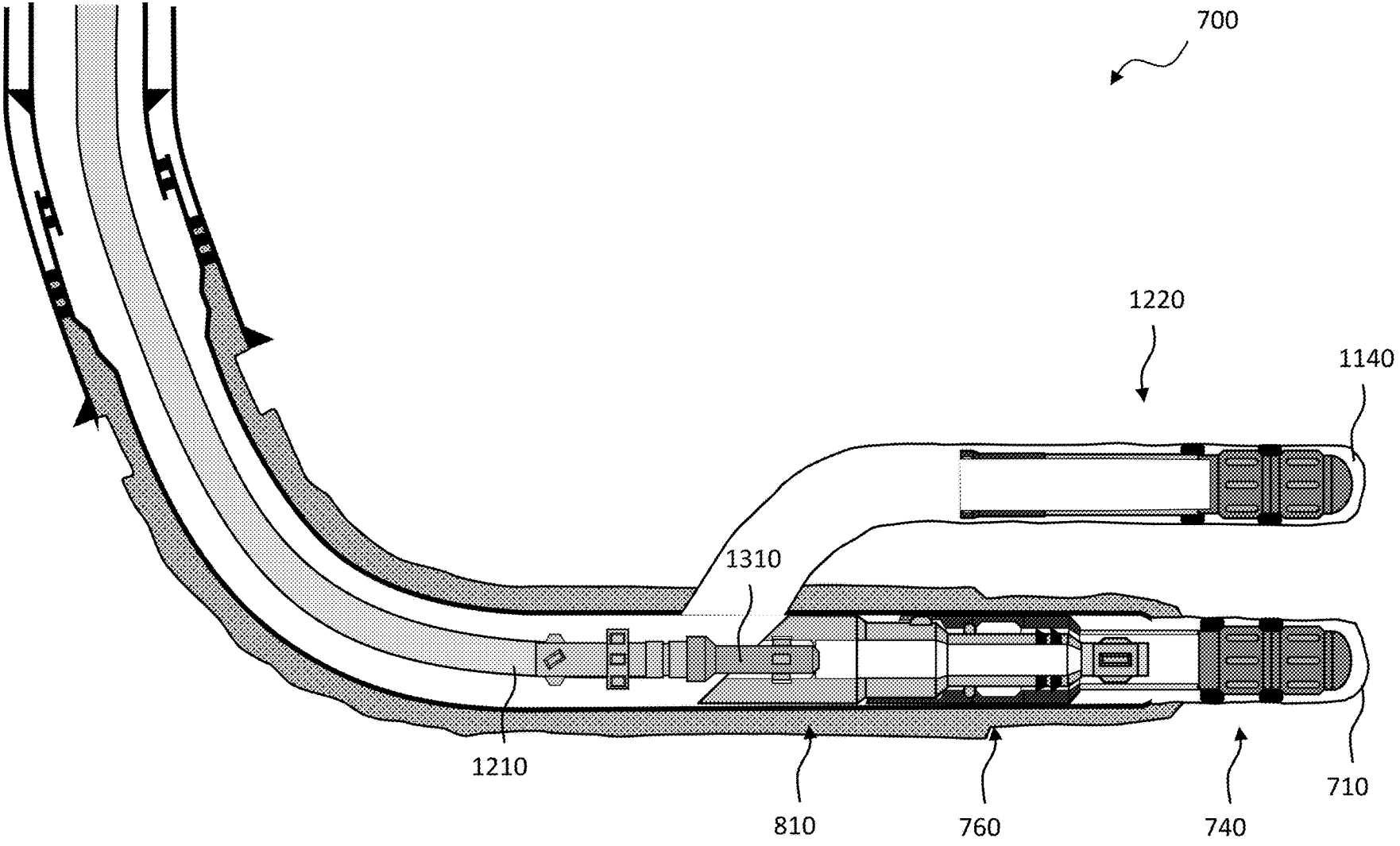

Turning to FIG. 13, illustrated is the well system 700 of FIG. 12 after latching a whipstock retrieval tool 1310 of the inner string 1210 with a profile in the whipstock assembly 810. The whipstock assembly 810 may then be pulled free from the anchor system 760, and then pulled out of hole. What results are the main wellbore completion 740 in the main wellbore 710, and the lateral wellbore completion 1220 in the lateral wellbore 1140.

Figure 14:
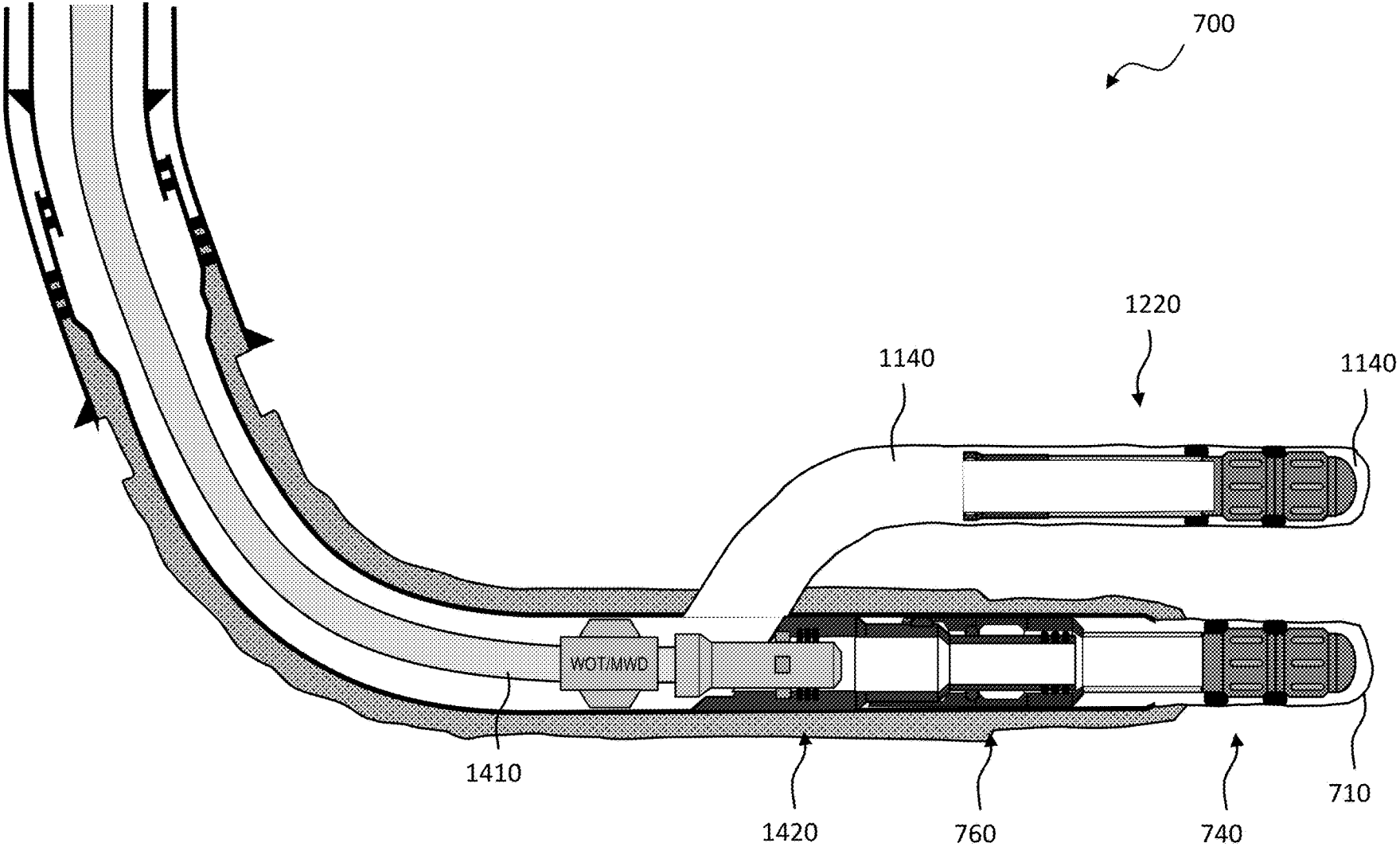

Turning to FIG. 14, illustrated is the well system 700 of FIG. 13 after employing a running tool 1410 to install a deflector assembly 1420 proximate a junction between the main wellbore 710 and the lateral wellbore 1140. The deflector assembly 1420 may be appropriately oriented using the WOT/MWD tool. The running tool 1410 may then be pulled out of hole.

Figure 15:
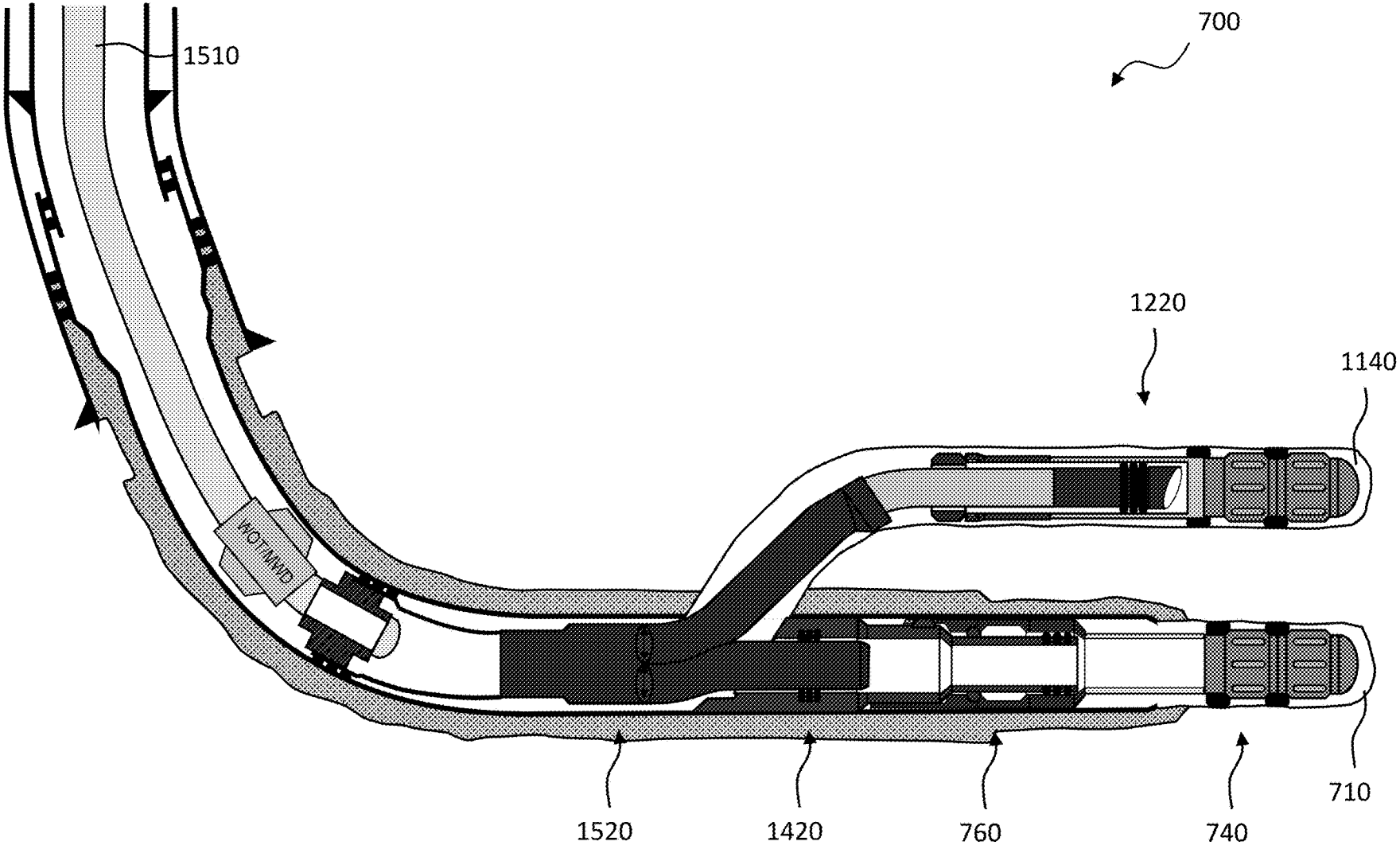

Turning to FIG. 15, illustrated is the well system 700 of FIG. 14 after employing a running tool 1510 to place a multilateral junction 1520 proximate an intersection between the main wellbore 710 and the lateral wellbore 1410. Accordingly, the multilateral junction 1520 may be installed as a unitary junction, wherein the y-block, mainbore leg, lateral bore leg and lateral completion engagement sub are all run at the same time. In other embodiments, other types of multilateral junctions 1520 maybe employed, such as a two-piece junction where a portion of the multilateral junction (e.g., the mainbore leg) is run separately prior to running of the other portion of the junction (e.g., lateral bore leg). In other embodiments, where large access to the mainbore and/or lateral leg is not required, a multilateral junction 1520 with smaller legs may be used. In accordance with one embodiment, the multilateral junction 1520 may include similar features as any of the multilateral junctions discussed above (e.g., multilateral junctions 300, 400, 500, 600), and thus may include an arced coupling or toothed coupling, among other relevant features.

Figure 16:
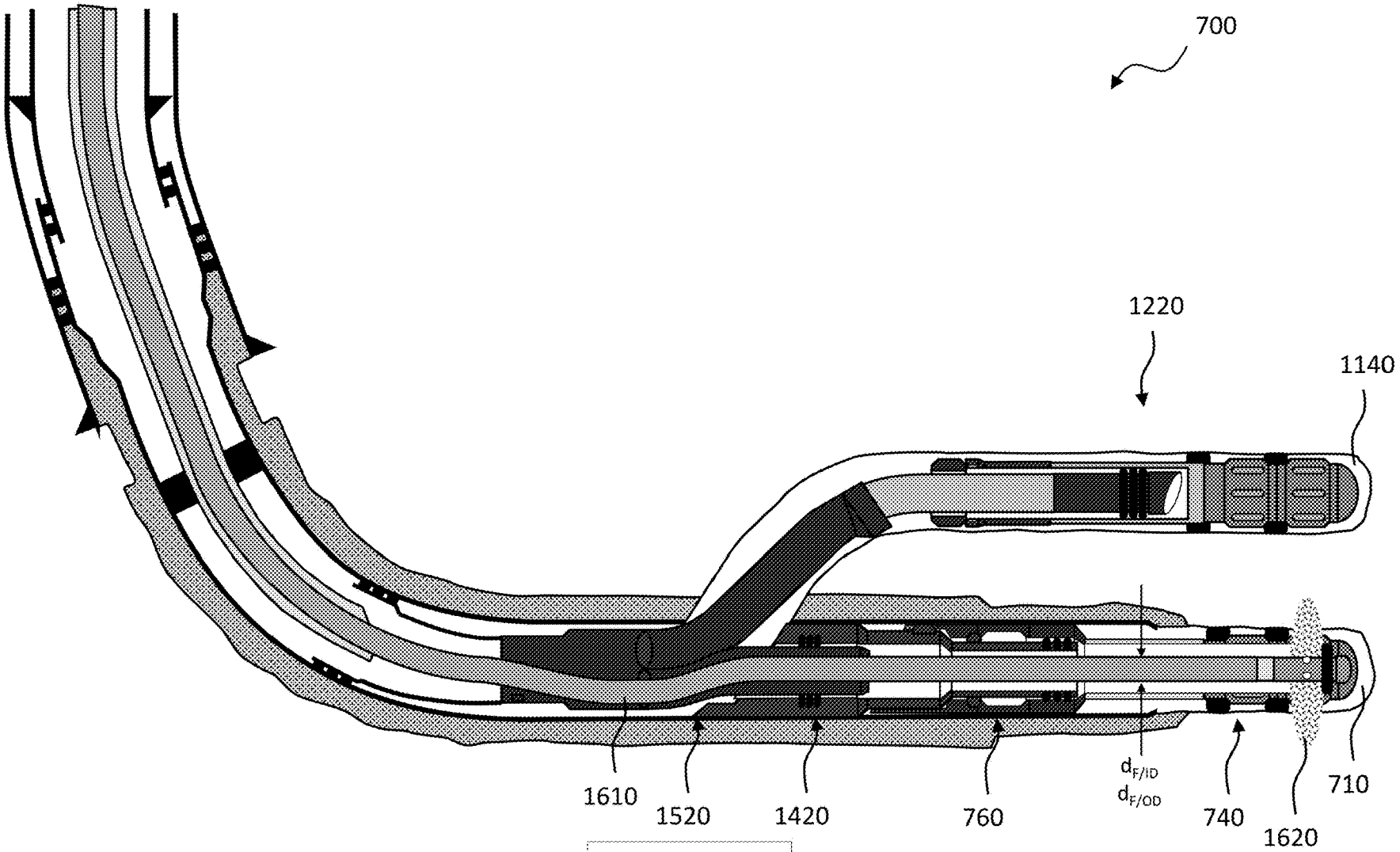

Turning to FIG. 16, illustrated is the well system 700 of FIG. 15 after selectively accessing the main wellbore 710 with a first intervention tool 1610 through the y-block of the multilateral junction 1520. In the illustrated embodiment, the first intervention tool 1610 is a first fracturing string, and more particularly a coiled tubing conveyed fracturing string. With the first intervention tool 1610 in place, fractures 1620 in the subterranean formation surrounding the main wellbore completion 740 may be formed. Thereafter, the first intervention tool 1610 may be pulled from the main wellbore completion 740.

Figure 17:
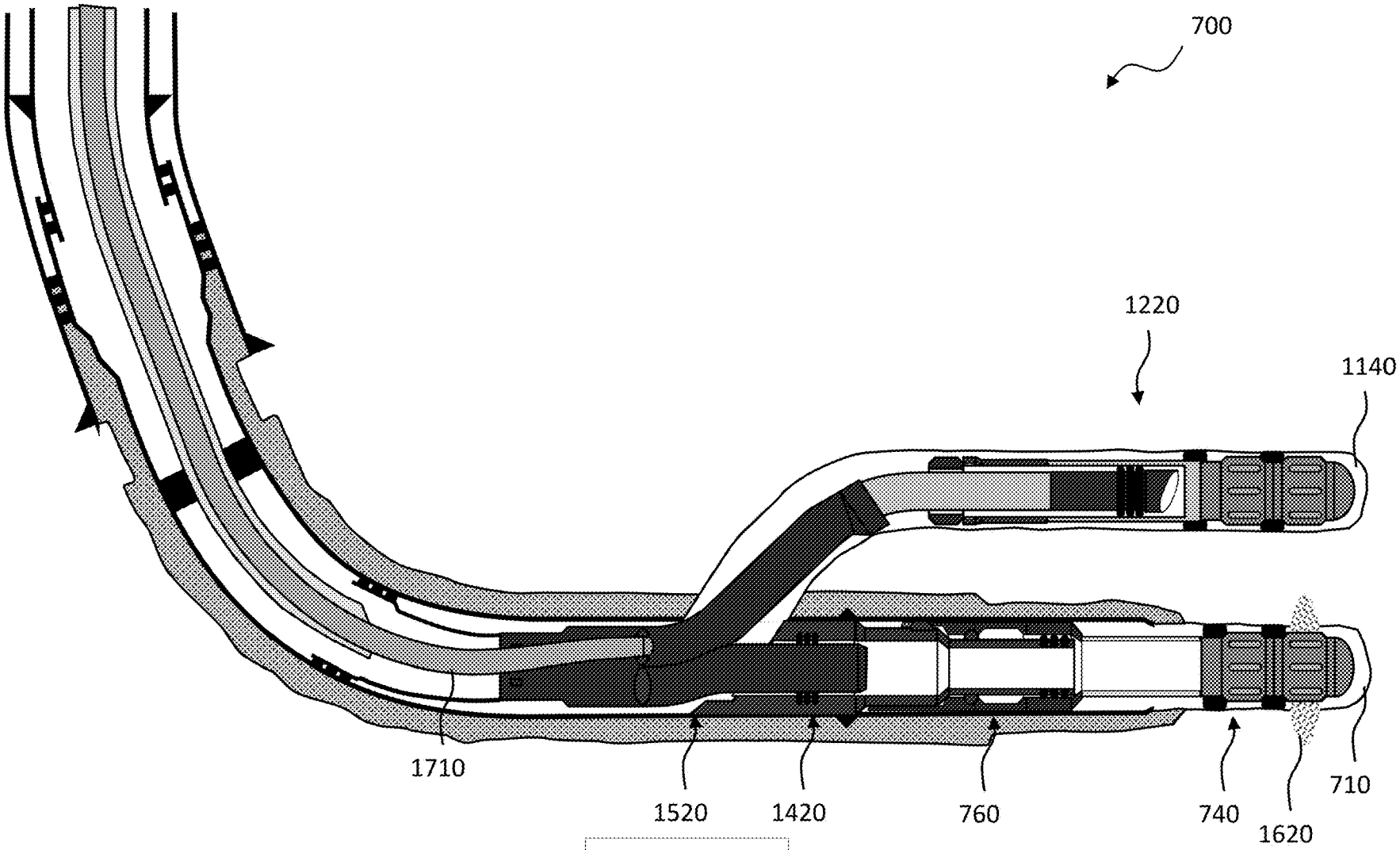

Turning to FIG. 17, illustrated is the well system 700 of FIG. 16 after positioning a second intervention tool 1710 within the multilateral junction 1520 including the y-block. In the illustrated embodiment, the second intervention tool 1710 is a second fracturing string, and more particularly a coiled tubing conveyed fracturing string.

Figure 18:
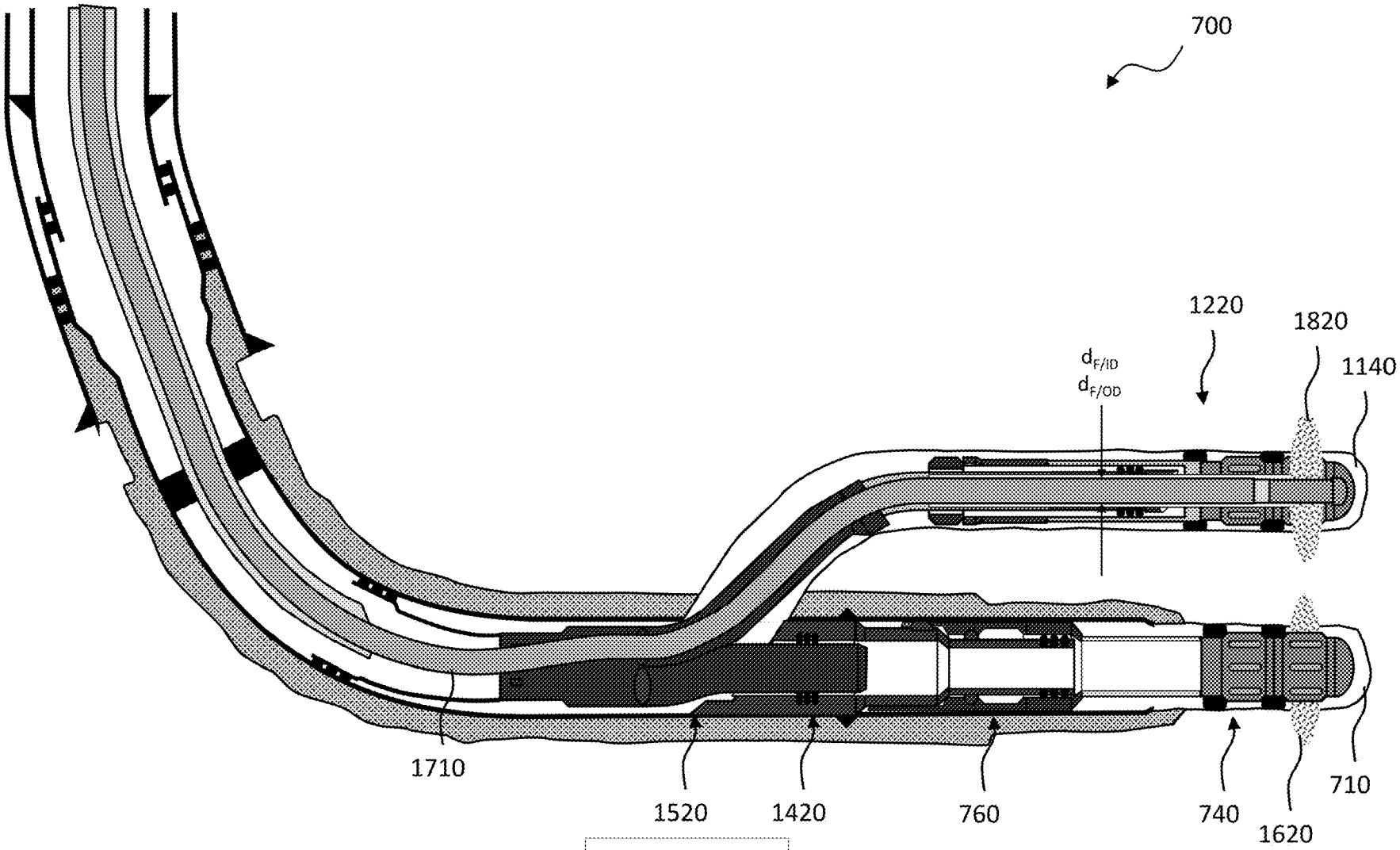

Turning to FIG. 18, illustrated is the well system 700 of FIG. 17 after putting additional weight down on the second intervention tool 1710 and causing the second intervention tool 1710 to enter the lateral wellbore 1140. With the downhole tool 1710 in place, fractures 1820 in the subterranean formation surrounding the lateral wellbore completion 1220 may be formed. In certain embodiments, the first intervention tool 1610 and the second intervention tool 1710 are the same intervention tool, and thus the same fracturing tool in one or more embodiments. Thereafter, the second intervention tool 1710 may be pulled from the lateral wellbore completion 1220 and out of the hole.

The embodiments discussed above reference that the main wellbore 710 is selectively accessed and fractured prior to the lateral wellbore 1140. Nevertheless, other embodiments may exist wherein the lateral wellbore 1140 is selectively accessed and fractured prior to the main wellbore 710. The embodiments discussed above additionally reference that both the main wellbore 710 and the lateral wellbore 1140 are selectively accessed and fractured through the y-block. Other embodiments may exist wherein only one of the main wellbore 710 or the lateral wellbore 1140 is selectively accessed and fractured through the y-block.

Figure 19:
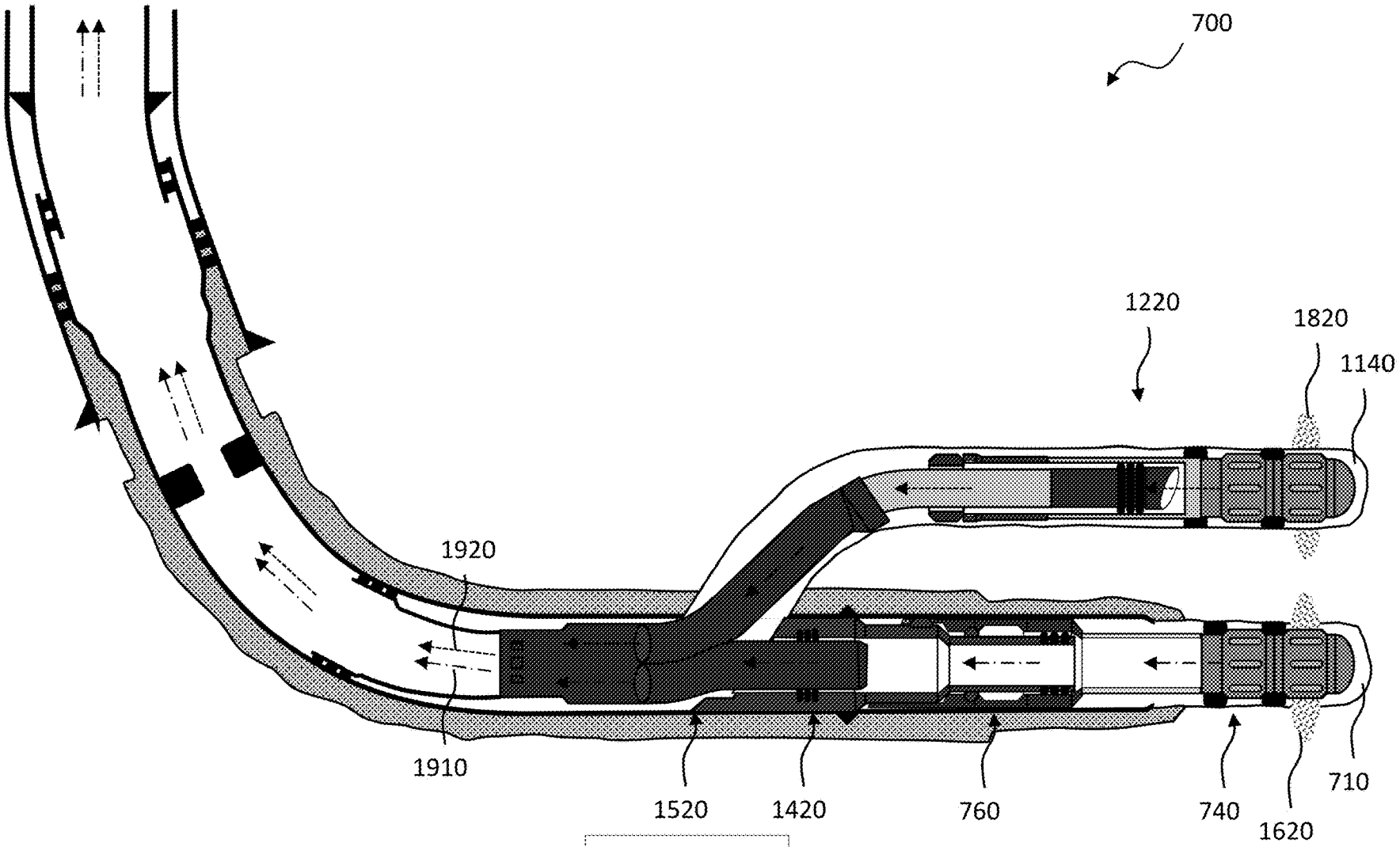

Turning to FIG. 19, illustrated is the well system 700 of FIG. 18 after producing fluids 1910 from the fractures 1620 in the main wellbore 710, and producing fluids 1920 from the fractures 1820 in the lateral wellbore 1140. The producing of the fluids 1910, 1920 occur through the multilateral junction 1520, and more specifically through the multilateral junction designed, manufactured and/or operated according to one or more embodiments of the disclosure.

Aspects Disclosed Herein Include:

A. A multilateral junction, the multilateral junction including: 1) a housing, the housing including: a) a first housing end and a second housing end; b) a bore extending through the housing from the first housing end to the second housing end; and c) a bore coupling profile located along an inside surface of the bore proximate the second housing end; 2) multilateral bore leg extending into the bore, the multilateral bore leg including: a) a tubular having a first tubular end and a second tubular end; and b) a tubular coupling profile located along an outside surface of the tubular proximate the first tubular end; and 3) an arced coupling located between the bore and the tubular and engaged with the bore coupling profile and the tubular coupling profile to axially fix the housing and the multilateral bore leg relative to one another B. A well system, the well system including: 1) a main wellbore; 2) a lateral wellbore extending from the main wellbore; and 3) a multilateral junction positioned at an intersection of the main wellbore and the lateral wellbore, the multilateral junction including; a) a housing, the housing including: i) a first housing end and a second housing end; and ii) a bore extending through the housing from the first housing end to the second housing end; and iii) a bore coupling profile located along an inside surface of the bore proximate the second housing end; b) a multilateral bore leg extending into the bore, the multilateral bore leg including: i) a tubular having a first tubular end and a second tubular end; and ii) a tubular coupling profile located along an outside surface of the tubular proximate the first tubular end; and c) an arced coupling located between the bore and the tubular and engaged with the bore coupling profile and the tubular coupling profile to axially fix the housing and the multilateral bore leg relative to one another.

C. A multilateral junction, the multilateral junction including: 1) a housing, the housing including: a) a first housing end and a second housing end; b) a bore extending through the housing from the first housing end to the second housing end; and c) a toothed coupling profile located along an inside surface of the bore proximate the second housing end; 2) a multilateral bore leg extending into the bore, the multilateral bore leg including a tubular having a first tubular end and a second tubular end; and 3) a toothed coupling located between the bore and the tubular and engaged with the toothed coupling profile and the tubular to axially fix the housing and the multilateral bore leg relative to one another.

D. A well system, the well system including: 1) a main wellbore; 2) a lateral wellbore extending from the main wellbore; and 3) a multilateral junction positioned at an intersection of the main wellbore and the lateral wellbore, the multilateral junction including; a) a housing, the housing including: i) a first housing end and a second housing end; and ii) a bore extending through the housing from the first housing end to the second housing end; and iii) a toothed coupling profile located along an inside surface of the bore proximate the second housing end; b) a multilateral bore leg extending into the bore, the multilateral bore leg including a tubular having a first tubular end and a second tubular end; and c) a toothed coupling located between the bore and the tubular and engaged with the toothed coupling profile and the tubular to axially fix the housing and the multilateral bore leg relative to one another.

Aspects A, B, C and D may have one or more of the following additional elements in combination: Element 1: wherein the housing is a y-block, and further wherein the bore includes: a single first bore extending into the y-block from the first housing end; and second and third bores branching off from the single first bore and exiting the y-block at the second housing end, the bore coupling profile located along an inside surface of the third bore proximate the second housing end. Element 2: wherein the second bore is a main leg bore, the third bore is a lateral leg bore, and the multilateral bore leg is a lateral bore leg, the bore coupling profile located along an inside surface of the lateral leg bore proximate the second housing end. Element 3: further including: a second lateral leg bore branching off from the single first bore and exiting the y-block at the second housing end; a second bore coupling profile located along an inside surface of the second lateral leg bore proximate the second housing end; a second lateral bore leg extending into the second lateral leg bore, the second lateral bore leg including: a second tubular having a third tubular end and a fourth tubular end; and a second tubular coupling profile located along an outside surface of the second tubular proximate the third tubular end; and a second arced coupling located between the second lateral leg bore and the second tubular and engaged with the second bore coupling profile and the second tubular coupling profile to axially fix the y-block and the second lateral bore leg relative to one another. Element 4: further including a main bore leg extending into and threadingly coupled with the main leg bore. Element 5: wherein the housing is a lateral completion engagement sub. Element 6: wherein the arced coupling includes a plurality of separate arced segments. Element 7: wherein the housing further includes an access port coupling an exterior of the housing and the bore coupling profile, the access port allowing for the insertion of the plurality of separate arced segments within the bore coupling profile when the bore coupling profile and the tubular coupling profile are axially aligned. Element 8: further including a locking member engageable with the plurality of separate arced segments or the access port, the locking member configured to prevent the plurality of arced segments from being removed from the bore coupling profile. Element 9: wherein the arced coupling is a C-ring. Element 10: wherein the arced coupling is a snap ring that resides in the tubular coupling profile and snaps outward into the bore coupling profile when the multilateral bore leg is insert within the bore, thereby axially fixing the housing and the multilateral bore leg relative to one another. Element 11: wherein the arced coupling is a snap ring that resides in the bore coupling profile and snaps inward into the tubular coupling profile when the multilateral bore leg is insert within the bore, thereby axially fixing the housing and the multilateral bore leg relative to one another. Element 12: wherein the arced coupling has a rectangular cross-section. Element 13: wherein the arced coupling has a toothed cross-section. Element 14: further including a seal member located between the bore and the tubular and axially positioned between the arced coupling and first tubular end. Element 15: wherein the multilateral bore leg further includes a second toothed coupling profile located along an outside surface of the tubular proximate the first tubular end, the toothed coupling located between the bore and the tubular and engaged with the toothed coupling profile and the second toothed coupling profile to axially fix the housing and the multilateral bore leg relative to one another. Element 16: wherein the housing is a y-block, and further wherein the bore includes: a single first bore extending into the y-block from the first housing end; and second and third bores branching off from the single first bore and exiting the y-block at the second housing end, the toothed coupling profile located along an inside surface of the third bore proximate the second housing end. Element 17: wherein the second bore is a main leg bore, the third bore is a lateral leg bore, and the multilateral bore leg is a lateral bore leg, the toothed coupling profile located along an inside surface of the lateral leg bore proximate the second housing end. Element 18: further including: a second lateral leg bore branching off from the single first bore and exiting the y-block at the second housing end; a third toothed coupling profile located along an inside surface of the second lateral leg bore proximate the second housing end; a second lateral bore leg extending into the second lateral leg bore, the second lateral bore leg including a second tubular having a third tubular end and a fourth tubular end; and a second toothed coupling located between the second lateral leg bore and the second tubular and engaged with the third toothed coupling profile and the second tubular to axially fix the housing and the second lateral bore leg relative to one another. Element 19: further including a main bore leg extending into and threadingly coupled with the main leg bore. Element 20: wherein the housing is a lateral completion engagement sub. Element 21: wherein the toothed coupling has directionally angled teeth that allow the multilateral bore leg to be insert within the bore while preventing the multilateral bore leg from being removed from the bore. Element 22: wherein the toothed coupling is a lock ring that is configured to ratchet onto the tubular when the multilateral bore leg is being insert within the bore. Element 23: wherein the toothed coupling is a C-ring or collet.

Those skilled in the art to which this application relates will appreciate that other and further additions, deletions, substitutions and modifications may be made to the described embodiments.

What is claimed is:

1. A multilateral junction, comprising:

a housing comprising a y-block, the housing including:

a first housing end and a second housing end;

a single first bore extending into the y-block from the first housing end;

second and third bores branching off from the single first bore and exiting the y-block at the second housing end; and a bore coupling profile located along an inside surface of the third bore proximate the second housing end;

a multilateral bore leg extending into the third bore, the multilateral bore leg including:

a tubular having a first tubular end and a second tubular end; and a tubular coupling profile located along an outside surface of the tubular proximate the first tubular end; and an arced coupling located between the third bore and the tubular and engaged with the bore coupling profile and the tubular coupling profile to axially fix the housing and the multilateral bore leg relative to one another.

2. The multilateral junction as recited in claim 1, wherein the second bore is a main leg bore, the third bore is a lateral leg bore, and the multilateral bore leg is a lateral bore leg, the bore coupling profile located along an inside surface of the lateral leg bore proximate the second housing end.

3. The multilateral junction as recited in claim 2, further including:

a second lateral leg bore branching off from the single first bore and exiting the y-block at the second housing end;

a second bore coupling profile located along an inside surface of the second lateral leg bore proximate the second housing end;

a second lateral bore leg extending into the second lateral leg bore, the second lateral bore leg including:

a second tubular having a third tubular end and a fourth tubular end; and a second tubular coupling profile located along an outside surface of the second tubular proximate the third tubular end; and a second arced coupling located between the second lateral leg bore and the second tubular and engaged with the second bore coupling profile and the second tubular coupling profile to axially fix the y-block and the second lateral bore leg relative to one another.

4. The multilateral junction as recited in claim 2, further including a main bore leg extending into and threadingly coupled with the main leg bore.

5. The multilateral junction as recited in claim 1, wherein the housing is a lateral completion engagement sub.

6. The multilateral junction as recited in claim 1, wherein the arced coupling includes a plurality of separate arced segments.

7. The multilateral junction as recited in claim 6, wherein the housing further includes an access port coupling an exterior of the housing and the bore coupling profile, the access port allowing for the insertion of the plurality of separate arced segments within the bore coupling profile when the bore coupling profile and the tubular coupling profile are axially aligned.

8. The multilateral junction as recited in claim 7, further including a locking member engageable with the plurality of separate arced segments or the access port, the locking member configured to prevent the plurality of arced segments from being removed from the bore coupling profile.

9. The multilateral junction as recited in claim 1, wherein the arced coupling is a C-ring.

10. The multilateral junction as recited in claim 1, wherein the arced coupling is a snap ring that resides in the tubular coupling profile and snaps outward into the bore coupling profile when the multilateral bore leg is insert within the bore, thereby axially fixing the housing and the multilateral bore leg relative to one another.

11. The multilateral junction as recited in claim 1, wherein the arced coupling is a snap ring that resides in the bore coupling profile and snaps inward into the tubular coupling profile when the multilateral bore leg is insert within the bore, thereby axially fixing the housing and the multilateral bore leg relative to one another.

12. The multilateral junction as recited in claim 1, wherein the arced coupling has a rectangular cross-section.

13. The multilateral junction as recited in claim 1, wherein the arced coupling has a toothed cross-section.

14. The multilateral junction as recited in claim 1, further including a seal member located between the bore and the tubular and axially positioned between the arced coupling and first tubular end.

15. A well system, comprising:

a main wellbore;

a lateral wellbore extending from the main wellbore; and a multilateral junction positioned at an intersection of the main wellbore and the lateral wellbore, the multilateral junction including;

a housing comprising a y-block, the housing including:

a first housing end and a second housing end;

a single first bore extending into the y-block from the first housing end;

second and third bores branching off from the single first bore and exiting the y-block at the second housing end; and a bore coupling profile located along an inside surface of the third bore proximate the second housing end;

a multilateral bore leg extending into the third bore, the multilateral bore leg including:

a tubular having a first tubular end and a second tubular end; and a tubular coupling profile located along an outside surface of the tubular proximate the first tubular end; and an arced coupling located between the third bore and the tubular and engaged with the bore coupling profile and the tubular coupling profile to axially fix the housing and the multilateral bore leg relative to one another.

16. The well system as recited in claim 15, wherein the second bore is a main leg bore, the third bore is a lateral leg bore, and the multilateral bore leg is a lateral bore leg, the bore coupling profile located along an inside surface of the lateral leg bore proximate the second housing end.

17. The well system as recited in claim 16, further including:

a second lateral leg bore branching off from the single first bore and exiting the y-block at the second housing end;

a second bore coupling profile located along an inside surface of the second lateral leg bore proximate the second housing end;

a second lateral bore leg extending into the second lateral leg bore, the second lateral bore leg including:

a second tubular having a third tubular end and a fourth tubular end; and a second tubular coupling profile located along an outside surface of the second tubular proximate the third tubular end; and a second arced coupling located between the second lateral leg bore and the second tubular and engaged with the second bore coupling profile and the second tubular coupling profile to axially fix the y-block and the second lateral bore leg relative to one another.

18. The well system as recited in claim 16, further including a main bore leg extending into and threadingly coupled with the main leg bore, the main bore leg extending into the main wellbore and the lateral bore leg extending into the lateral wellbore.

19. The well system as recited in claim 15, wherein the housing is a lateral completion engagement sub.

20. The well system as recited in claim 15, wherein the arced coupling includes a plurality of separate arced segments.

21. The well system as recited in claim 20, wherein the housing further includes an access port coupling an exterior of the housing and the bore coupling profile, the access port allowing for the insertion of the plurality of separate arced segments within the bore coupling profile when the bore coupling profile and the tubular coupling profile are axially aligned.

22. The well system as recited in claim 21, further including a locking member engageable with the plurality of separate arced segments or the access port, the locking member configured to prevent the plurality of arced segments from being removed from the bore coupling profile.

23. The well system as recited in claim 15, wherein the arced coupling is a C-ring.

24. The well system as recited in claim 15, wherein the arced coupling is a snap ring that resides in the tubular coupling profile and snaps outward into the bore coupling profile when the multilateral bore leg is insert within the bore, thereby axially fixing the housing and the multilateral bore leg relative to one another.

25. The well system as recited in claim 15, wherein the arced coupling is a snap ring that resides in the bore coupling profile and snaps inward into the tubular coupling profile when the multilateral bore leg is insert within the bore, thereby axially fixing the housing and the multilateral bore leg relative to one another.

26. The well system as recited in claim 15, wherein the arced coupling has a rectangular cross-section.

27. The well system as recited in claim 15, wherein the arced coupling has a toothed cross-section.

28. The well system as recited in claim 15, further including a seal member located between the bore and the tubular and axially positioned between the arced coupling and first tubular end.

* * * * *